US012780504B2

(12) United States Patent
Lohrman et al.

(10) Patent No.: US 12,780,504 B2
(45) **Date of Patent: *Nov. 3, 2026**

(54) TETHERED, HINGED CLOSURE

(71) Applicant: Silgan White Cap LLC, Downers Grove, IL (US)

(72) Inventors: Richard D. Lohrman, Montgomery, IL (US); Sungsuk Steve Kim, Batavia, IL (US); Gary L. Berge, Crystal Lake, IL (US); Dustin Vance, Lombard, IL (US); Darren R. Neputy, Palos Hills, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/249,630

(22) Filed: Jun. 25, 2025

(65) Prior Publication Data

US 2025/0320035 A1 Oct. 16, 2025

Related U.S. Application Data

(63) Continuation of application No. 17/681,391, filed on Feb. 25, 2022, now Pat. No. 12,358,693, which is a (Continued)

(51) Int. Cl.
*B65D 41/34* (2006.01)
*B65D 55/16* (2006.01)

(52) U.S. Cl.
CPC ..... *B65D 41/3428* (2013.01); *B65D 41/3447* (2013.01); *B65D 55/16* (2013.01); *B65D 2401/30* (2020.05)

(58) Field of Classification Search
CPC ..... B65D 2251/1008; B65D 41/3447; B65D 41/3428; B65D 55/16; B65D 2401/30
(Continued)

(56) References Cited

U.S. PATENT DOCUMENTS 2,990,077 A 6/1961 Baarn
3,335,889 A 8/1967 Brumme
(Continued)

FOREIGN PATENT DOCUMENTS

CA 2990674 9/2018
CN 1631740 6/2005
(Continued)

OTHER PUBLICATIONS

International Search Report and Written Opinion for International Application No. PCT/US2020/049493, dated Dec. 17, 2020, 13 pages.
(Continued)

*Primary Examiner* — Anthony D Stashick
*Assistant Examiner* — Raven Collins
(74) *Attorney, Agent, or Firm* — Reinhart Boerner Van Deuren s.c.

(57) ABSTRACT

A closure includes a cap having a top wall and a skirt perpendicular to the top wall and extending downwardly from the top wall to a lower edge. The skirt includes an inner surface having a sealing formation. A band is concentric with and attached to the lower edge of the skirt by a plurality of frangible members. The band remains coupled to the body of the closure even after being removed from a container.

20 Claims, 24 Drawing Sheets

Related U.S. Application Data continuation of application No. PCT/US2020/049459, filed on Sep. 4, 2020.

(60) Provisional application No. 63/023,543, filed on May 12, 2020, provisional application No. 63/004,184, filed on Apr. 2, 2020, provisional application No. 62/900,917, filed on Sep. 16, 2019, provisional application No. 62/897,005, filed on Sep. 6, 2019.

(58) Field of Classification Search
USPC ..... 215/252
See application file for complete search history.

(56) References Cited

U.S. PATENT DOCUMENTS

| | | | |
|---|---|---|---|
| 3,441,161 | A | 4/1969 | Van Baarn |
| 4,394,918 | A | 7/1983 | Grussen |
| 4,557,393 | A | 12/1985 | Boik |
| 4,565,295 | A | 1/1986 | Mori et al. |
| 4,666,053 | A | 5/1987 | Corcoran et al. |
| 4,805,792 | A | 2/1989 | Lecinski, Jr. |
| 5,215,204 | A | 6/1993 | Beck et al. |
| 5,295,600 | A | 3/1994 | Kowal |
| 5,360,126 | A | 11/1994 | Snyder et al. |
| 5,398,837 | A | 3/1995 | Degrassi |
| 5,676,269 | A | 10/1997 | Blake et al. |
| 5,725,115 | A | 3/1998 | Bosl et al. |
| 5,735,418 | A | 4/1998 | Erb et al. |
| 5,779,075 | A | 7/1998 | Salmon et al. |
| 5,853,095 | A | 12/1998 | Marshall et al. |
| 6,102,257 | A | 8/2000 | Goyet |
| 6,116,443 | A | 9/2000 | Parrinello |
| 6,372,167 | B1 | 4/2002 | Morini |
| 6,474,491 | B1 | 11/2002 | Benoit-Gonin et al. |
| 6,478,184 | B2 | 11/2002 | Berge et al. |
| 6,986,434 | B1 | 1/2006 | Getsy et al. |
| 7,314,150 | B2 | 1/2008 | Skillen |
| D593,856 | S | 6/2009 | Kubler |
| 7,712,618 | B2 | 5/2010 | Barre et al. |
| D648,215 | S | 11/2011 | Rigling et al. |
| 8,469,213 | B2 | 6/2013 | Ishii et al. |
| 8,490,805 | B2 | 7/2013 | Giraud et al. |
| 8,602,234 | B2 | 12/2013 | Hayashi |
| 8,695,822 | B2 | 4/2014 | Kwon |
| 8,720,716 | B2 | 5/2014 | Campbell |
| 9,010,555 | B2 | 4/2015 | Luzzato et al. |
| 9,108,774 | B2 | 8/2015 | Kwon |
| 9,376,243 | B2 | 6/2016 | Cerveny |
| 9,643,762 | B2 | 5/2017 | Maguire |
| 9,776,779 | B2 | 10/2017 | Campbell |
| 9,828,146 | B2 | 11/2017 | Maguire |
| 9,932,159 | B2 | 4/2018 | Maguire |
| 9,975,677 | B2 | 5/2018 | Maguire |
| 10,138,035 | B2 | 11/2018 | Loukov |
| 10,272,599 | B2 | 4/2019 | Cerveny |
| 10,518,942 | B2 | 12/2019 | Seibert et al. |
| 10,647,486 | B2 | 5/2020 | Maguire |
| 10,654,624 | B2 | 5/2020 | Sung |
| 10,654,625 | B2 | 5/2020 | Migas et al. |
| 10,836,549 | B2 | 11/2020 | Maguire |
| 10,981,700 | B2 | 4/2021 | Migas et al. |
| 11,040,806 | B2 | 6/2021 | Naumann et al. |
| 11,697,534 | B2 | 7/2023 | Bassi |
| 2003/0136783 | A1 | 7/2003 | Hatsumoto et al. |
| 2006/0021959 | A1 | 2/2006 | Falzoni |
| 2006/0049204 | A1 | 3/2006 | Seelhofer |
| 2006/0071000 | A1 | 4/2006 | Weist et al. |
| 2006/0163281 | A1 | 7/2006 | Weist |
| 2007/0151993 | A1 | 7/2007 | Yelland |
| 2008/0087625 | A1 | 4/2008 | Kumata |
| 2008/0105640 | A1 | 5/2008 | Ott |
| 2008/0185384 | A1 | 8/2008 | Bolli |
| 2009/0236304 | A1 | 9/2009 | Watson |
| 2009/0302037 | A1 | 12/2009 | Rigling |
| 2010/0237073 | A1 | 9/2010 | Alther et al. |
| 2010/0326948 | A1 | 12/2010 | Campbell |
| 2011/0000871 | A1 | 1/2011 | Bernard et al. |
| 2011/0174760 | A1 | 7/2011 | Luzzato et al. |
| 2012/0024815 | A1 | 2/2012 | Kwon |
| 2012/0298666 | A1 | 11/2012 | Kwon |
| 2013/0001184 | A1 | 1/2013 | Groubert |
| 2013/0001185 | A1 | 1/2013 | Antier et al. |
| 2015/0144630 | A1 | 5/2015 | Backes et al. |
| 2015/0259109 | A1 | 9/2015 | Vetten et al. |
| 2018/0118423 | A1 | 5/2018 | Bois et al. |
| 2018/0186505 | A1 | 7/2018 | Peterges et al. |
| 2018/0370701 | A1 | 12/2018 | Maguire |
| 2019/0071222 | A1 | 3/2019 | Druitt |
| 2019/0106246 | A1 | 4/2019 | Kendall |
| 2019/0344933 | A1 | 11/2019 | Kim |
| 2019/0344944 | A1 | 11/2019 | Maguire |
| 2019/0375555 | A1 | 12/2019 | Edie et al. |
| 2020/0017260 | A1 | 1/2020 | Migas et al. |
| 2020/0115115 | A1 | 4/2020 | Migas et al. |
| 2020/0207525 | A1 | 7/2020 | Sung |
| 2020/0369446 | A1 | 11/2020 | Melan-Moutet |
| 2020/0377259 | A1 | 12/2020 | Reisert et al. |
| 2020/0399036 | A1 | 12/2020 | Dai |
| 2020/0407124 | A1 | 12/2020 | Caszatt et al. |
| 2021/0039838 | A1 | 2/2021 | Hanan |
| 2021/0094733 | A1 | 4/2021 | Bloom et al. |
| 2021/0094736 | A1 | 4/2021 | Maguire |
| 2021/0179324 | A1 | 6/2021 | Hanan |
| 2021/0188488 | A1 | 6/2021 | Dreyer et al. |
| 2021/0221572 | A1 | 7/2021 | Migas |
| 2022/0002021 | A1 | 1/2022 | Krautkramer |

FOREIGN PATENT DOCUMENTS

| | | |
|---|---|---|
| CN | 1631741 | 6/2005 |
| CN | 1830730 | 9/2006 |
| CN | 201209040 | 3/2009 |
| CN | 102700822 | 10/2012 |
| CN | 102700823 | 10/2012 |
| DE | 9318243 | 2/1994 |
| DE | 4123732 | 8/1998 |
| DE | 102009010681 | 1/2010 |
| DE | 202019106993 | 1/2020 |
| DE | 202019106992 | 2/2020 |
| DE | 102018128886 | 7/2020 |
| DE | 102018130541 | 7/2020 |
| DE | 102019132541 | 11/2020 |
| DE | 102020107184 | 5/2021 |
| DE | 102019132538 | 6/2021 |
| DE | 202021103289 | 8/2021 |
| EP | 1529736 | 5/2005 |
| EP | 1961669 | 8/2008 |
| EP | 3081505 | 10/2016 |
| EP | 3135600 | 3/2017 |
| EP | 3336003 | 6/2018 |
| EP | 3584190 | 12/2019 |
| EP | 3715275 | 9/2020 |
| EP | 3715276 | 9/2020 |
| EP | 3766797 | 1/2021 |
| EP | 3798150 | 3/2021 |
| EP | 3831736 | 6/2021 |
| ES | 1266291 | 4/2021 |
| FR | 2711969 | 5/1995 |
| FR | 2953202 | 6/2011 |
| FR | 3084881 | 2/2020 |
| FR | 3093709 | 9/2020 |
| JP | 11-500091 | 1/1999 |
| JP | 2001019002 | 1/2001 |
| JP | 2004307006 | 11/2004 |
| JP | 2005041566 | 2/2005 |
| JP | 2005289488 | 10/2005 |
| JP | 4906441 | 3/2008 |
| JP | 2011-201559 | 10/2011 |
| JP | 2014-061929 | 4/2014 |
| JP | 5520768 | 6/2014 |
| JP | 5574582 | 8/2014 |
| JP | 5600461 | 10/2014 |
| KR | 20-0213792 | 2/2001 |

(56) References Cited

FOREIGN PATENT DOCUMENTS

| | | |
|---|---|---|
| KR | 10-0855086 | 8/2008 |
| KR | 20080093839 | 10/2008 |
| KR | 10-0872159 | 1/2009 |
| KR | 10-0942642 | 2/2010 |
| KR | 10-0981240 | 9/2010 |
| KR | 1017448460000 | 6/2017 |
| MX | 2007015318 | 2/2008 |
| WO | WO94/14674 | 7/1994 |
| WO | WO00/26108 | 5/2000 |
| WO | WO2002/062674 | 8/2002 |
| WO | WO2005/073098 | 8/2005 |
| WO | WO2008/142413 | 11/2008 |
| WO | WO2009/048273 | 4/2009 |
| WO | WO2010/040961 | 4/2010 |
| WO | WO2015/061834 | 5/2015 |
| WO | WO2016/160591 | 10/2016 |
| WO | WO2019/031779 | 2/2019 |
| WO | WO2019/175740 | 9/2019 |
| WO | WO2019/177616 | 9/2019 |
| WO | WO2020/041640 | 2/2020 |
| WO | WO2020/050823 | 3/2020 |
| WO | WO2020/077162 | 4/2020 |
| WO | WO2020/093058 | 5/2020 |
| WO | WO2020/099516 | 5/2020 |
| WO | WO2020/156847 | 8/2020 |
| WO | WO2020/157695 | 8/2020 |
| WO | WO2020/182854 | 9/2020 |
| WO | WO2020/201227 | 10/2020 |
| WO | WO2020/212426 | 10/2020 |
| WO | WO2020/227813 | 11/2020 |
| WO | WO2021/005428 | 1/2021 |
| WO | WO2021/005505 | 1/2021 |
| WO | WO2021/013370 | 1/2021 |
| WO | WO2021/014287 | 1/2021 |
| WO | WO2021/018740 | 2/2021 |
| WO | WO2021/018772 | 2/2021 |
| WO | WO2021/018775 | 2/2021 |
| WO | WO2021/019419 | 2/2021 |
| WO | WO2021/021095 | 2/2021 |
| WO | WO2021/053488 | 3/2021 |
| WO | WO2021/067412 | 4/2021 |
| WO | WO2021/068058 | 4/2021 |
| WO | WO2021/074726 | 4/2021 |
| WO | WO2021/074727 | 4/2021 |
| WO | WO2021/074728 | 4/2021 |
| WO | WO2021/080550 | 4/2021 |
| WO | WO2021/099323 | 5/2021 |
| WO | WO2021/099358 | 5/2021 |

OTHER PUBLICATIONS

International Search Report and Written Opinion for International Application No. PCT/US2020/049459, dated Dec. 8, 2020, 13 pages.

International Search Report and Written Opinion for International Application No. PCT/US2020/049453, dated Dec. 14, 2020, 13 pages.

TETHERED, HINGED CLOSURE

CROSS-REFERENCE TO RELATED PATENT APPLICATIONS

The present application is a continuation of U.S. application Ser. No. 17/681,391, filed Feb. 25, 2022, which is a continuation of International Application No. PCT/US2020/049459, filed Sep. 4, 2020, which claims the benefit of and priority to U.S. Application No. 62/900,917, filed Sep. 16, 2019, U.S. Application No. 62/897,005, filed Sep. 6, 2019, and U.S. Application No. 63/004,184, filed Apr. 2, 2020, and U.S. Application No. 63/023,543, filed May 12, 2020, each of which are incorporated herein by reference in their entirety.

BACKGROUND OF THE INVENTION

The present disclosure relates generally to the field of closures for containers. The present disclosure relates specifically to a closure for a container having a cap and a tab, with the tab maintaining the cap in an open position.

SUMMARY OF THE INVENTION

According to an embodiment, this disclosure relates to a closure including a top panel including an upper surface and a lower surface, a rotational axis about which the top panel is centered, a cylindrical wall extending from the lower surface of the top panel to a bottom edge of the cylindrical wall, an inner surface of the cylindrical wall facing towards the rotational axis, a retention band pivotally coupled to the cylindrical wall, the retention band attached to the bottom edge by a plurality of frangible members, the frangible members providing a visual indication, when broken, that the closure has been opened, a line of weakness that separates the cylindrical wall and the retention band, wherein the plurality of frangible members extend across the line of weakness and connect the cylindrical wall and the retention band, the line of weakness extending circumferentially around the closure from a first end to a second end, and a tab that extends from the cylindrical wall, the tab configured to interface against a neck of the container to bias the cylindrical wall of the closure away from the container neck.

In a specific embodiment, the closure includes a first aperture extending vertically between the retention band and the cylindrical wall, the first aperture connected with the first end of the line of weakness when the closure is opened, and a second aperture extending vertically between the retention band and the cylindrical wall, the second aperture connected with the second end of the line of weakness when the closure is opened, the tab being located circumferentially between the first aperture and the second aperture. In a specific embodiment, the tab is defined by a third aperture defined between the cylindrical wall and the retention band. In a specific embodiment, the third aperture includes a lower portion that extends circumferentially around the closure from a first end to a second end, a first vertical portion that extends from the first end of the lower portion towards the top panel, and a second vertical portion that extends from the second end of the lower portion towards the top panel. In a specific embodiment, the closure including a first aperture extending vertically between the retention band and the cylindrical wall, the first aperture connected with the first end of the line of weakness when the closure is opened, and a second aperture extending vertically between the retention band and the cylindrical wall, the second aperture connected with the second end of the line of weakness when the closure is opened, the tab being located between the first aperture and the second aperture. In a specific embodiment, the closure includes a first tether located between the first aperture and the third aperture, the first tether maintaining a coupling between the cylindrical wall and the retention band when the closure is opened, and a second tether located between the second aperture and the third aperture, the second tether maintaining a coupling between the cylindrical wall and the retention band when the closure is opened. In a specific embodiment, the third aperture includes a lower portion that extends circumferentially around the closure from a first end to a second end, a first vertical portion that extends from the first end of the lower portion towards the top panel, and a second vertical portion that extends from the second end of the lower portion towards the top panel. In a specific embodiment, the closure includes an interference band that extends from the retention band inwardly towards the rotational axis, the interference band extending a first length from a base of the retention band at a first location beneath the tab, and the interference band extending a second length from the base of the retention band at a second location, the second location being opposite the first location with respect to the rotational axis, and the second length being greater than the first length. In a specific embodiment, the first length is less than 75% of a third length from a bottom of the retention band to a top of the retention band.

According to another embodiment, this disclosure relates to a closure including a top panel including an upper surface and a lower surface, a rotational axis around which the top panel is centered, a rotational axis about which the top panel is centered, a cylindrical wall extending from the lower surface of the top panel to a bottom edge of the cylindrical wall, an inner surface of the cylindrical wall facing towards the rotational axis, a retention band pivotally coupled to the cylindrical wall, the retention band attached to the bottom edge by a plurality of frangible members, the frangible members providing a visual indication, when broken, that the closure has been opened, a first line of weakness that separates the cylindrical wall and the retention band, the plurality of frangible members extending across the first line of weakness and connecting the cylindrical wall and the retention band, the first line of weakness extending circumferentially around the closure from a first end to a second end, a second line of weakness that extends circumferentially around the retention band, and a tab that extends from the cylindrical wall, the tab configured to interface against a neck of the container to bias the cylindrical wall of the closure away from the container neck.

In a specific embodiment, the tab is located between the second line of weakness and the top panel. In a specific embodiment, the closure includes a first aperture extending vertically between the retention band and the cylindrical wall, the first aperture connected with the first end of the first line of weakness when the closure is opened, and a second aperture extending vertically between the retention band and the cylindrical wall, the second aperture connected with the second end of the first line of weakness when the closure is opened, the tab being located circumferentially between the first aperture and the second aperture. In a specific embodiment, the tab is defined by a third aperture defined between the cylindrical wall and the retention band. In a specific embodiment, the third aperture includes a lower portion that extends horizontally around the closure from a first end to a second end, a first vertical portion that extends from the first end of the lower portion towards the top panel, and a second vertical portion that extends from the second end of the lower portion towards the top panel. In a specific embodiment, the closure includes a first tether located between the first aperture and the tab, wherein the first tether maintains a coupling between the cylindrical wall and the retention band when the closure is opened, and a second tether located between the second aperture and the tab, the second tether maintaining a coupling between the cylindrical wall and the retention band when the closure is opened, the tab being located circumferentially between the first aperture and the second vertical aperture. In a specific embodiment, the closure includes an interference band that extends from the retention band inwardly towards the rotational axis, the interference band extends a first length from a base of the retention band at a first location beneath the tab, and the interference band extends a second length from the base of the retention band at a second location, wherein the second location is opposite the first location with respect to the rotational axis, and wherein the second length is greater than the first length. In a specific embodiment, the first length is less than 75% of a third length from a bottom of the retention band to a top of the retention band.

According to yet another embodiment, this disclosure relates to a closure including a top panel including an upper surface and a lower surface, a rotational axis about which the top panel is centered, a cylindrical wall extending from the lower surface of the top panel to a bottom edge of the cylindrical wall, an inner surface of the cylindrical wall facing towards the rotational axis, a retention band pivotally coupled to the cylindrical wall, the retention band attached to the bottom edge by a plurality of frangible members, the frangible members providing a visual indication, when broken, that the closure has been opened, a line of weakness that separates the cylindrical wall and the retention band, the plurality of frangible members extending across the line of weakness and connecting the cylindrical wall and the retention band, the line of weakness extending circumferentially around the closure from a first end to a second end, a first aperture extending vertically between the retention band and the cylindrical wall, the first aperture connected with the first end of the line of weakness when the closure is opened, a second aperture extending vertically between the retention band and the cylindrical wall, the second aperture connected with the second end of the line of weakness when the closure is opened, a tab that extends from the cylindrical wall, the tab configured to interface against a neck of the container to bias the cylindrical wall of the closure away from the container neck, a first tether located between the first aperture and the tab, the first tether maintaining a coupling between the cylindrical wall and the retention band when the closure is opened, and the first tether including a line of weakness that facilitates the first tether being deformed, and a second tether located between the second aperture and the tab, the second tether maintaining a coupling between the cylindrical wall and the retention band when the closure is opened, and the first tether including a line of weakness that facilitates the second tether being deformed.

In a specific embodiment, the tab is defined by a third aperture defined between the cylindrical wall and the retention band, the third aperture including a lower portion that extends circumferentially around the closure from a first end to a second end, a first vertical portion that extends from the first end of the lower portion towards the top panel, and a second vertical portion that extends from the second end of the lower portion towards the top panel. In a specific embodiment, the closure includes an interference band that extends from the retention band inwardly towards the rotational axis, the interference band extends a first length from a base of the retention band at a first location beneath the tab, and the interference band extends a second length from the base of the retention band at a second location, the second location being opposite the first location with respect to the rotational axis, and the second length being greater than the first length.

In yet another embodiment, this disclosure relates to a closure for closing a container having a neck portion defining an opening to the container, with the neck portion including a mating sealing formation and a mating attachment formation, includes a cap having a top wall and a skirt perpendicular to the top wall and extending downwardly from the top wall to a lower edge. The skirt includes an inner surface having a sealing formation. A band is concentric with and attached to the lower edge of the skirt by a plurality of first frangible members. A tab is formed at a hinge location from the band and extending from the lower edge of the skirt to a pair of first co-linear slits in the band separated by a second frangible member. The tab is bounded by a pair of second slits extending from the lower edge of the skirt to the pair of first co-linear slits, with each of the pair of second slits being separated from a respective first co-linear slit by a respective third frangible member. When the closure is applied to the neck portion of the container, the sealing formation engages the mating sealing formation, and the band engages the mating attachment formation to seal the container. When the cap is removed from the neck portion, all of the frangible members are broken. The band remains engaged with the mating attachment formation. The cap remains attached to the band at the hinge location, and the tab interacts with the mating attachment formation to maintain an open cap position, wherein the cap is retained displaced from the opening of the container.

In yet another embodiment, this disclosure relates to a closure for closing a container having a neck portion defining an opening to the container, with the neck portion including at least one neck thread and engagement ring, includes a cap having a top wall and a skirt perpendicular to the top wall and extending downwardly from the top wall to a lower edge of the skirt. The skirt includes an inner surface having at least one mating thread. A band is formed at the lower edge of the skirt. A plurality of first co-linear slits is separated by respective first frangible elements and defines a top edge of the band which extends to a lower edge of the band at which a retention ring for engaging the engagement ring is formed. A tab is formed from the band and extends from the top edge of the band to a pair of second co-linear slits in the band separated by a second frangible element. The tab is bounded by a pair of third slits extending between respective first co-linear slits and respective second co-linear slits. A first hinge portion extends between one of the respective first co-linear slits and third slits, and a second hinge portion extends between the other of the respective first co-linear slits and third slits. Each of the third slits is separated from a respective second slit by a respective third frangible element. When the closure is applied to the neck portion of the container, the mating thread engages the neck thread, and the retention ring engages the engagement ring to seal the container. When the cap is removed from the neck portion, all of the frangible elements are broken. The band remains engaged with the mating attachment formation, and the cap remains attached to the band by the first and second hinge portions. The tab interacts with the engagement ring to maintain an open cap position wherein the cap is retained displaced from the opening of the container.

In yet another embodiment, this disclosure relates to a closure for closing a container having a neck portion defining an opening to the container, with neck portion including a mating sealing formation and a mating attachment formation, includes a cap having a top wall and a skirt perpendicular to the top wall and extending downwardly from the top wall to a lower edge. The skirt includes an inner surface having a sealing formation. A band is concentric with and attached to the lower edge of the skirt by a plurality of first frangible members. A tab is formed at a hinge location from the band and extends from the lower edge of the skirt to a pair of first co-linear slits in the band separated by a second frangible member. The tab is bounded by a pair of second slits extending from the lower edge of the skirt to the pair of first co-linear slits, and each of the pair of second slits is separated from a respective first co-linear slit by a respective third frangible member to form a shape of a trapezoid. Each of the second slits forms an angle from 40° to 50° with the lower edge of the skirt relative to a horizontal axis. When the closure is applied to the neck portion of the container, the sealing formation engages the mating sealing formation, and the band engages the mating attachment formation to seal the container. When the cap is removed from the neck portion, all of the frangible members are broken. The band remains engaged with the mating attachment formation. The cap remains attached to the band at the hinge location, and the tab interacts with the mating attachment formation to maintain an open cap position wherein the cap is retained displaced from the opening of the container.

Additional features and advantages will be set forth in the detailed description which follows, and in part will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide a further understanding and are incorporated in and constitute a part of this specification. The drawings illustrate one or more embodiments and together with the description serve to explain principles and operation of the various embodiments.

DETAILED DESCRIPTION

Figure 1:
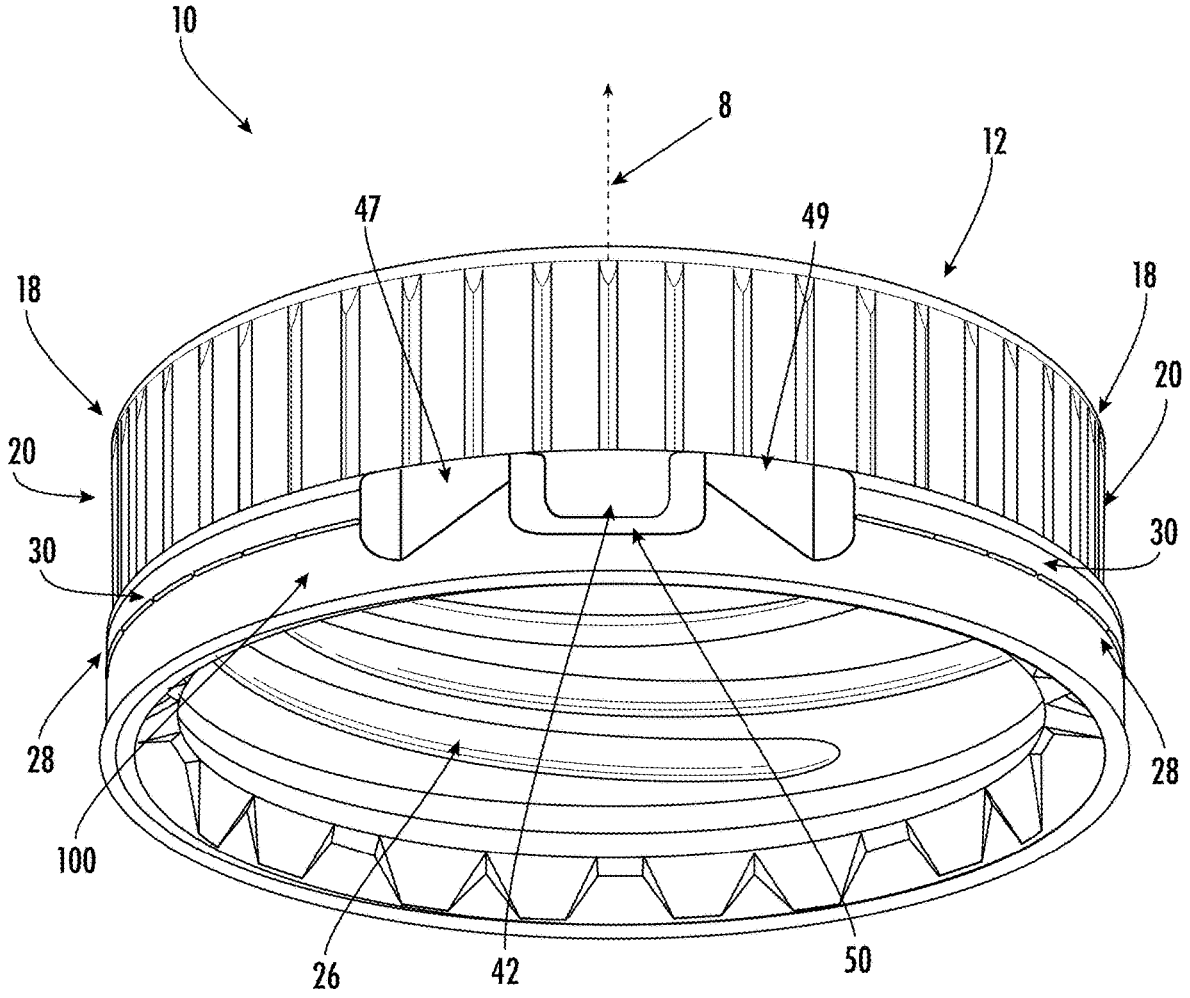
FIG. 1 is a perspective view of a closure, according to an exemplary embodiment.
Figure 2:
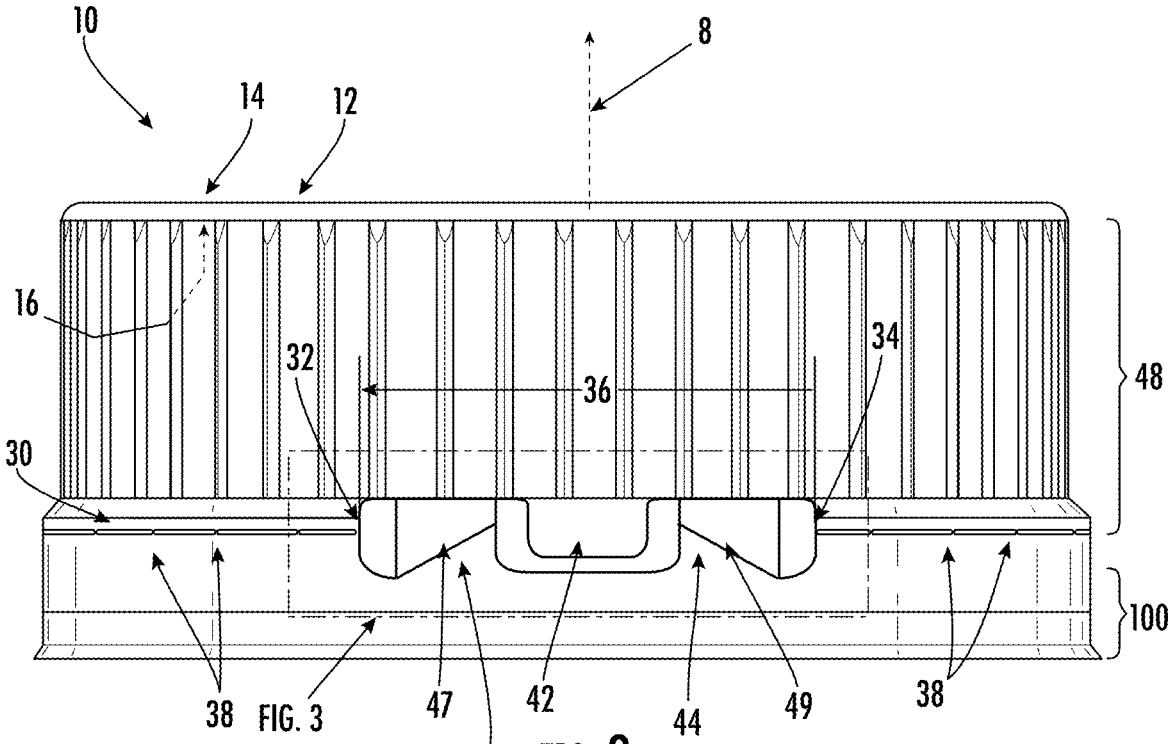
FIG. 2 is a back view of the closure of FIG. 1, according to an exemplary embodiment.
Figure 3:
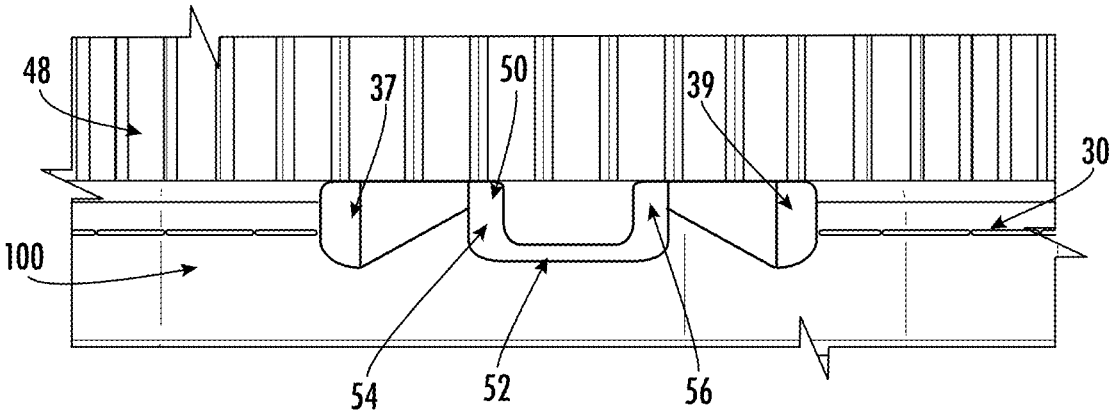
FIG. 3 is a detailed back view of the closure of FIG. 1, according to an exemplary embodiment.
Figure 4:
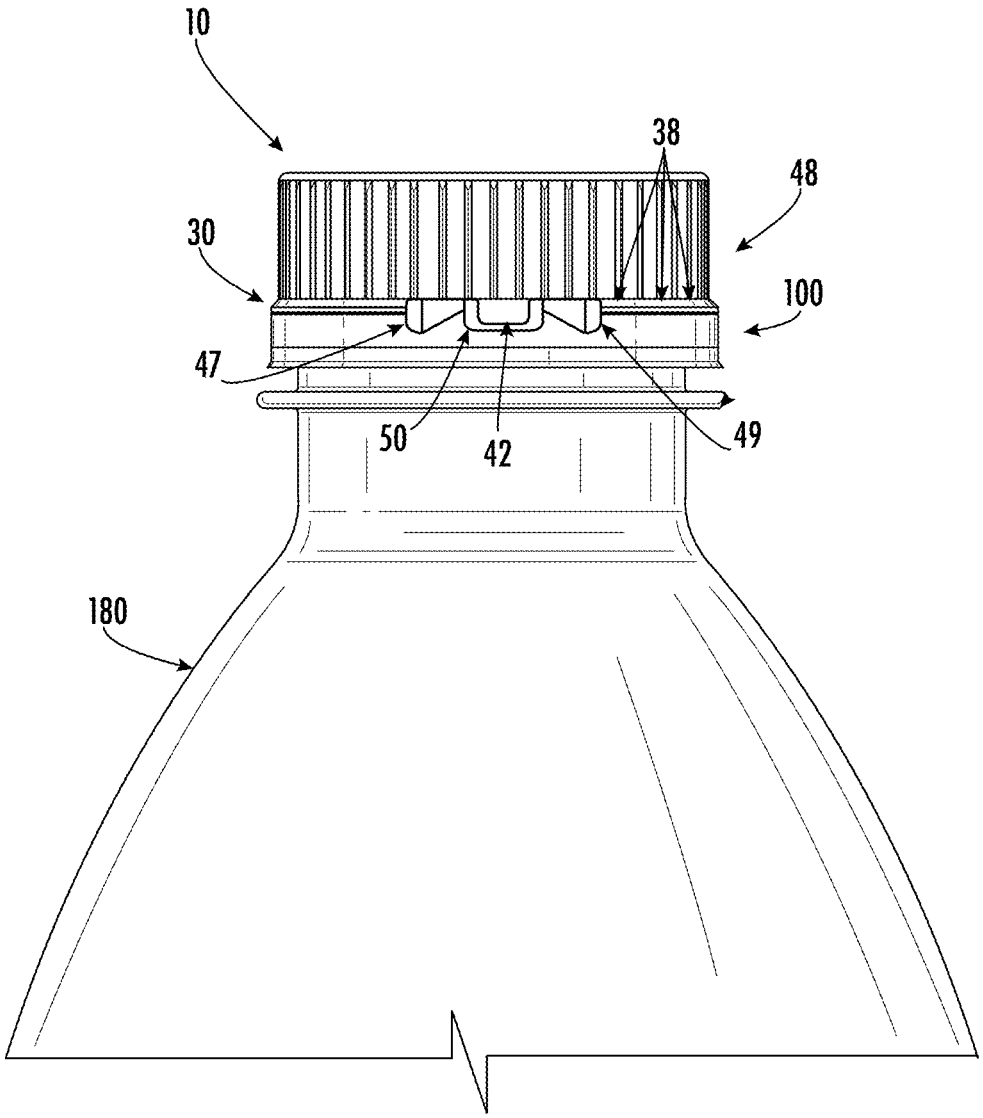
FIG. 4 is a back view of the closure of FIG. 1 on a container, according to an exemplary embodiment.
Figure 5:
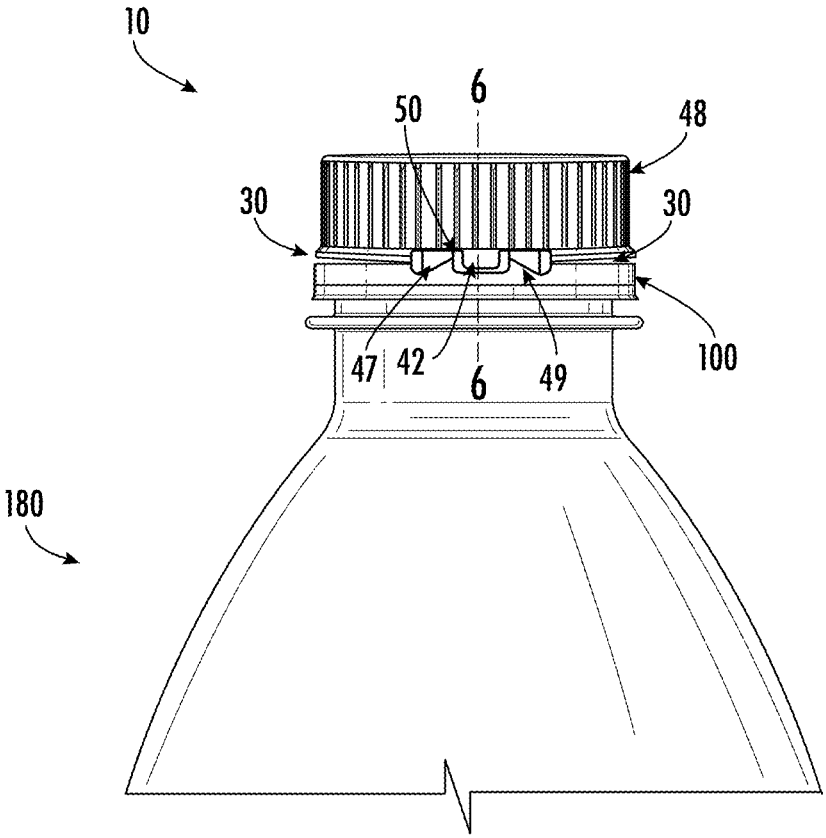
FIG. 5 is a back view of the closure of FIG. 1 on a container shown in a different configuration than shown in FIG. 4, according to an exemplary embodiment.

Referring first to FIGS. 1-12, in an embodiment, a closure 10, for closing a container 180 is shown. The closure 10 includes a top panel, shown as top wall 12, and a cylindrical wall, shown as skirt 20, perpendicular to the top wall 12. The skirt 20 extends downwardly from a bottom surface 16 of an outer periphery 18 of top wall 12 to a bottom edge 28 of skirt 20, shown as lower edge 28. An upper surface 14 of top wall 12 faces away from bottom surface 16 of top panel 12. The top wall 12 and skirt 20 are centered around rotational axis 8.

An upper weakened section, shown as a upper slit 30, includes one or more frangible connections 38 that extend across upper slit 30 to couple body 48 to retaining band 100. When closure 10 is initially opened, frangible connections 38 break providing a visual indication that closure 10 has been opened. Body 48 of closure 10 is above upper slit 30 and a retention band, shown as retaining band 100, is below upper slit 30. Upper slit 30 extends circumferentially around closure 10 from first end 32 to second end 34. Angle 36 is defined as angular separation of first end 32 from second end 34 with respect to rotational axis 8 of closure 10.

As is described in more detail below, tab 42 extends from body 48 of closure 10 towards retaining band 100. Connecting portions, shown as left tether 47 and right tether 49, maintain a coupling between body 48 and retaining band 100 even when closure 10 is opened.

Left tether 47 is separated from tab 42 by second weakened portion, shown as aperture 50. Aperture 50 includes lower portion 52 that extends circumferentially around closure 10, left portion 54 that extends vertically from a first end of lower portion 52, and right portion 56 that extends vertically from an opposing second end of lower portion 52. Similarly, right tether 49 is separated from tab 42 by right portion 56 of aperture 50. Third aperture 50 is between retaining band 100 and body 48. Third aperture 50 defines tab 42.

First aperture 37 extends vertically between the retention band 100 and the skirt 20. First aperture 37 is connected with the first end 32 of the line of weakness 30 when the closure 10 is opened. Similarly second aperture 39 extends vertically between the retention band 100 and the skirt 20. The second aperture 39 is connected with the second end 34 of the line of weakness 30 when the closure 10 is opened. Tab 42 is located circumferentially between first aperture 37 and second aperture 39.

A first tether, shown as left tether 47, is located between the first aperture 37 and the third aperture 50. The left tether 47 maintains a coupling between the skirt 20 and the retention band 100 when the closure 10 is opened. A second tether, shown as right tether 49, is located between the second aperture 39 and the third aperture 50. The right tether 49 maintains a coupling between the skirt 20 and the retention band 100 when the closure 10 is opened.

As will be described in more detail below, when closure is opened for the first time, body 48 of closure pivots away from the container neck and the retaining band 100. Body 48 remains coupled to retaining band 100 via left tether 47 and right tether 49. Left tether 47 and right tether 49 each include a line of weakness, shown as diagonal lines of weakness 44, which are configured to facilitate left tether 47 and right tether 49 deforming as closure 10 is being opened.

As body 48 pivots away from the container neck, tab 42 pivots towards the container neck. Tab 42 is positionable and configured to interface against the container neck to bias body 48 (e.g., skirt 20) of closure 10 away from the container neck, thus allowing a user to drink from the container neck with reduced or no interference from body 48 of closure 10.

In various embodiments, aperture 50 does not include frangible members 38. In various other embodiments, aperture 50 includes frangible members 38. In various embodiments, one or more of the closures described herein, such as closure 460, are formed by injection molding, compression molding, cutting slits, and/or combinations thereof.

Figure 6:
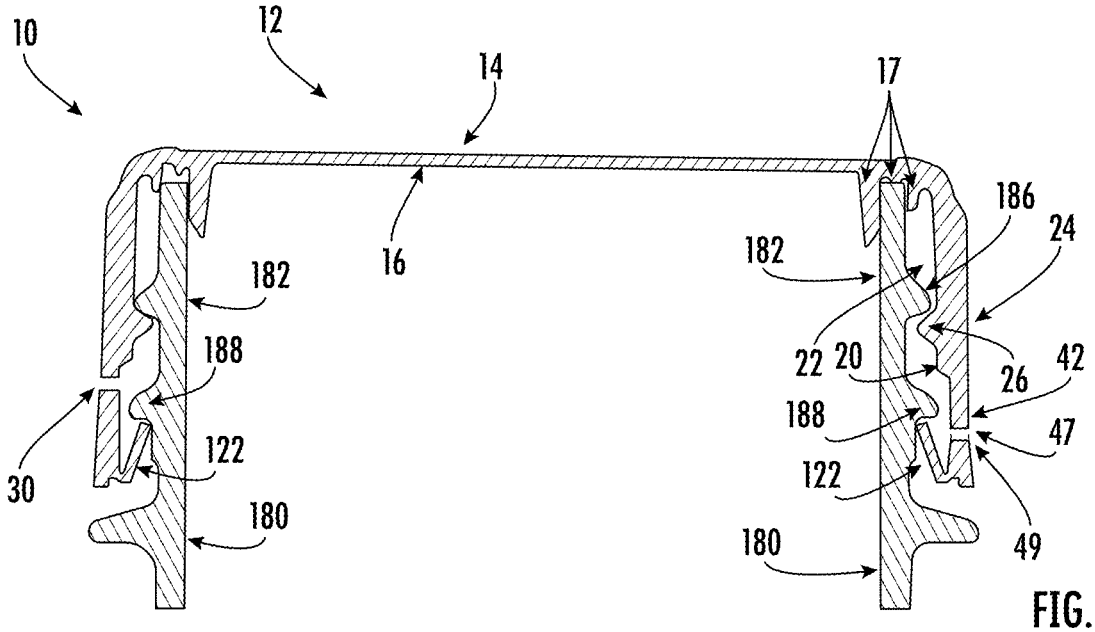
FIG. 6 is a cross-section view of the closure of FIG. 5 on a container taken along line 6-6 in FIG. 5, according to an exemplary embodiment.

Turning to FIG. 6, the interaction between the J-band and the container neck will be described. The container 180 includes a neck portion 182 defining an opening to the container 180. The neck portion 182 includes a mating sealing formation/neck thread 186 and a mating attachment formation/engagement ring 188. The skirt 20 includes an outer surface 24 and an opposing inner surface 22. The inner surface 22 includes a sealing/mating formation, shown as thread 26, to mate with the mating sealing formation/neck thread 186 of container 180. The closure 10 includes one or more sealing formations, shown as rings 17, that interface with neck portion 182 of container 180 to provide a fluid seal between closure 10 and container 180.

A retaining tamper-evidencing band, shown as band 100, includes at least one radially inwardly projecting retaining element, such as a J-band 122. J-band 122 is attached at a lower end to the inner surface of the tamper band via a J-band hinge. An upper, free end of the J-band is defined by an engagement surface. The retaining elements include a plurality of structures (e.g. beads, tabs, flanges) projecting radially inwards from the inner surface of band 100 and engage a corresponding retaining structure, such as annular projection 188 that extends from neck portion 182 of container 180.

When the closure 10 is applied to the neck portion 182 of the container 180, the sealing formation/mating thread 186 of container 180 engages the mating sealing formation/neck thread 26 of closure 10. One or more of rings 17 engage the mating attachment formation of container neck 180 to seal the container 180. When the closure 10 is removed from the neck portion 182, most or all of the frangible members 38 are broken, and the retaining band 100 remains engaged with the container neck 180. The body 48 of closure 10 remains attached to the retaining band 100 via left tether 47 and right tether 49. The tab 42 interacts with the mating attachment formation to maintain an open cap position wherein the body 48 of closure 10 is retained displaced from the opening of the container 180. In a specific embodiment, when body 48 of closure 10 is removed from neck portion 182, at least one of frangible members 38 break while at least one of frangible members 38 remain unbroken.

The tab 42 interacts with the mating attachment formation/engagement ring of the container neck to maintain an open cap position wherein the body 48 of closure 10 is retained displaced from the opening of the neck portion 182 of container 180. The left tether 47 and right tether 49 bias the tab 42 inward towards the neck portion 182 of the container 180, working together with the tab 42 to keep the body 48 in the open cap position on an angle θ (e.g., from 90° to 135°). In a specific embodiment, the tab 42 contacts the neck thread 26 while the body 48 is in the open cap position.

It is contemplated herein that slit 30 in closure 10 may be formed such as, for exemplary purposes only and without limitation, via being slit open by a cutting device from a fully formed closure, being molded into the final form, being injection molded into the final form, and/or being molded to include one or more of the slits and a blade being used to cut the remaining one or more slits.

Turning to FIGS. 5-12, the opening of closure 10 relative to neck portion 182 of container 180 is depicted. Starting at FIGS. 5-6, closure 10 is depicted at the moment that most and/or all of frangible connections 38 have broken. Sealing rings 17 of body 48 are still sealed with neck portion 182. FIG. 6 depicts a cross-section of the portion of closure 10 and container 180 identified in FIG. 5. Left tether 47 and right tether 49 are shown in dotted line in FIG. 6, because they are not located along the cross-section line identified in FIG. 5. Instead, left tether 47 and right tether 49 are located to either side of the cross-section line identified in FIG. 5.

Figure 7:
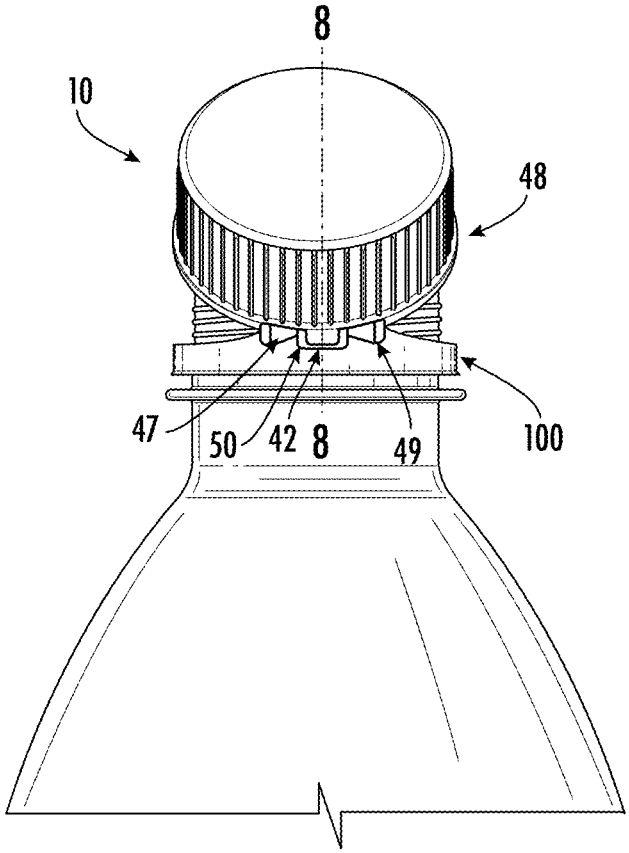
FIG. 7 is a back view of the closure of FIG. 1 on a container shown in a different configuration than shown in FIG. 5, according to an exemplary embodiment.
Figure 8:
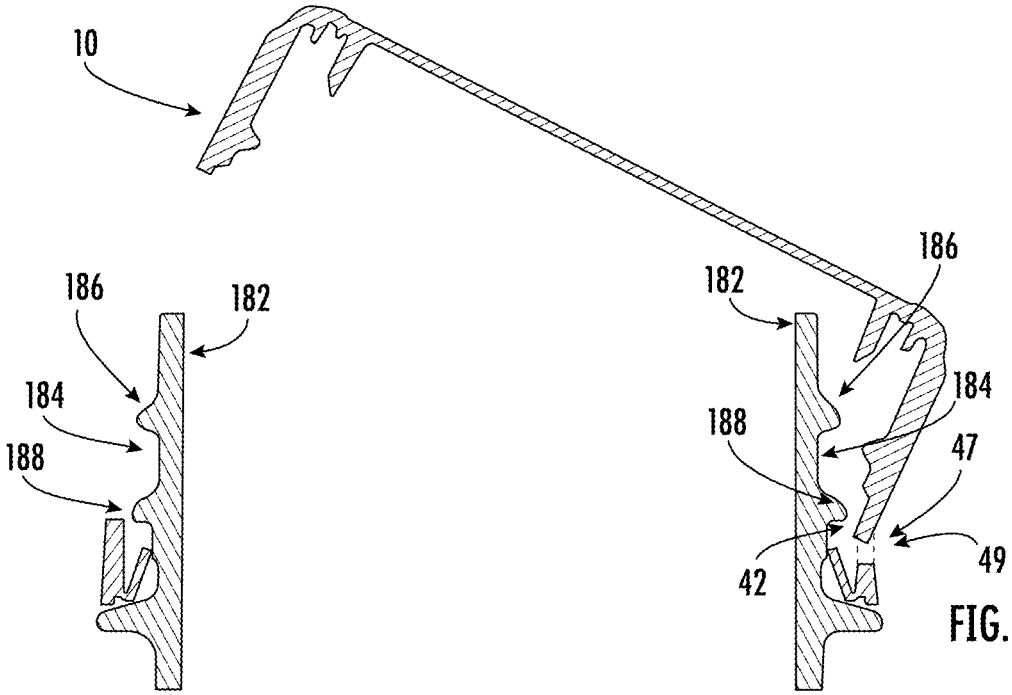
FIG. 8 is a cross-section view of the closure of FIG. 7 on a container taken along line 8-8 in FIG. 7, according to an exemplary embodiment.

Turning to FIGS. 7-8, body 48 of closure 10 is starting to pivot away from neck portion 182 of container 180. Body 48 remains coupled to retaining ring 100 via left tether 47 and right tether 49. Similar to FIGS. 5-6, left tether 47 and right tether 49 retain the coupling between body 48 and retaining band 100 and are shown in dotted line in FIG. 8 because they are not located along the cross-section line identified in FIG. 7. Tab 42 is starting to pivot towards container 180 but not yet interfacing with neck portion 182 of container 180.

Figure 9:
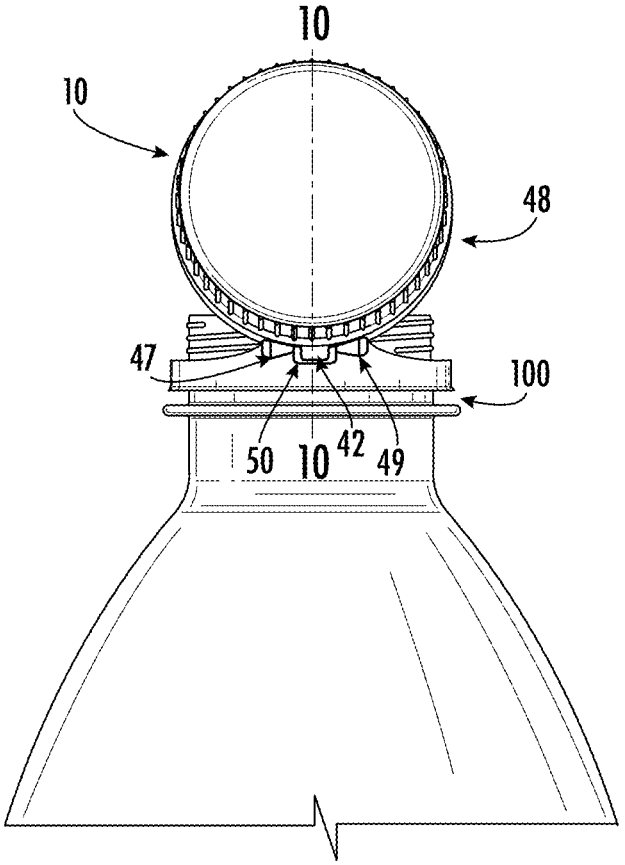
FIG. 9 is a back view of the closure of FIG. 1 on a container shown in a different configuration than shown in FIG. 7, according to an exemplary embodiment.
Figure 10:
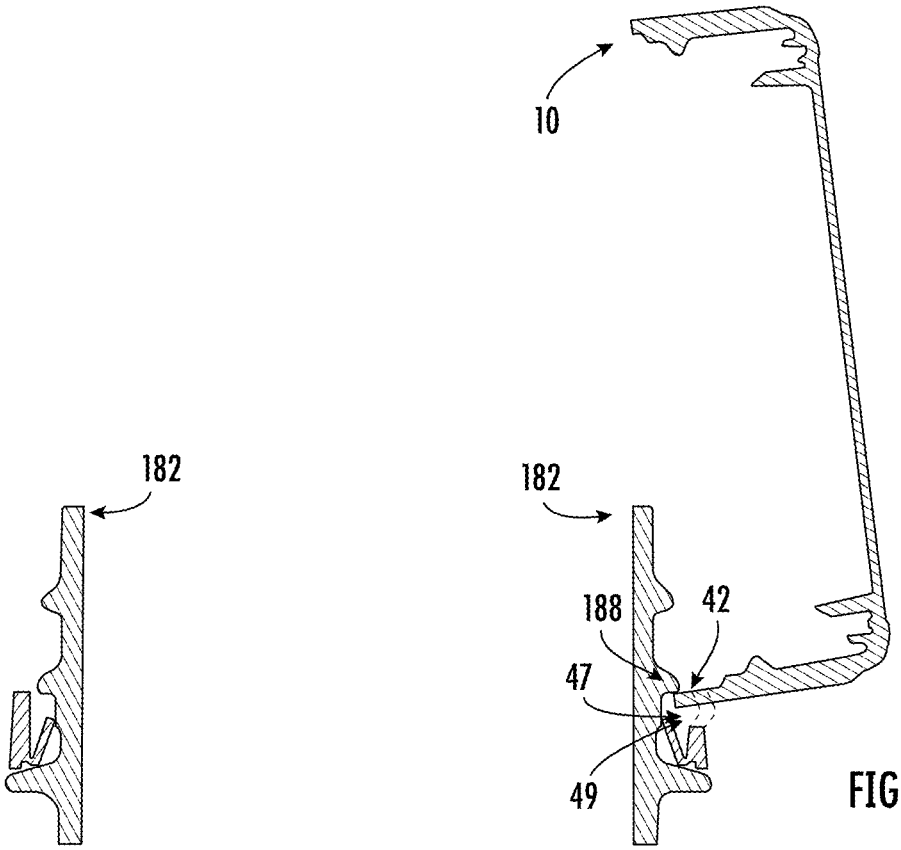
FIG. 10 is a cross-section view of the closure of FIG. 9 on a container taken along line 10-10 in FIG. 9, according to an exemplary embodiment.

Turning to FIGS. 9-10, body 48 of closure 10 is pivoted approximately halfway open from neck portion 182. Tab 42 is now interfacing against the bottom of annular projection 188 of container 180. Similar to FIGS. 5-8, left tether 47 and right tether 49 retain the coupling between body 48 and retaining band 100 and are shown in dotted line in FIG. 10 because they are not located along the cross-section line identified in FIG. 9.

Figure 11:
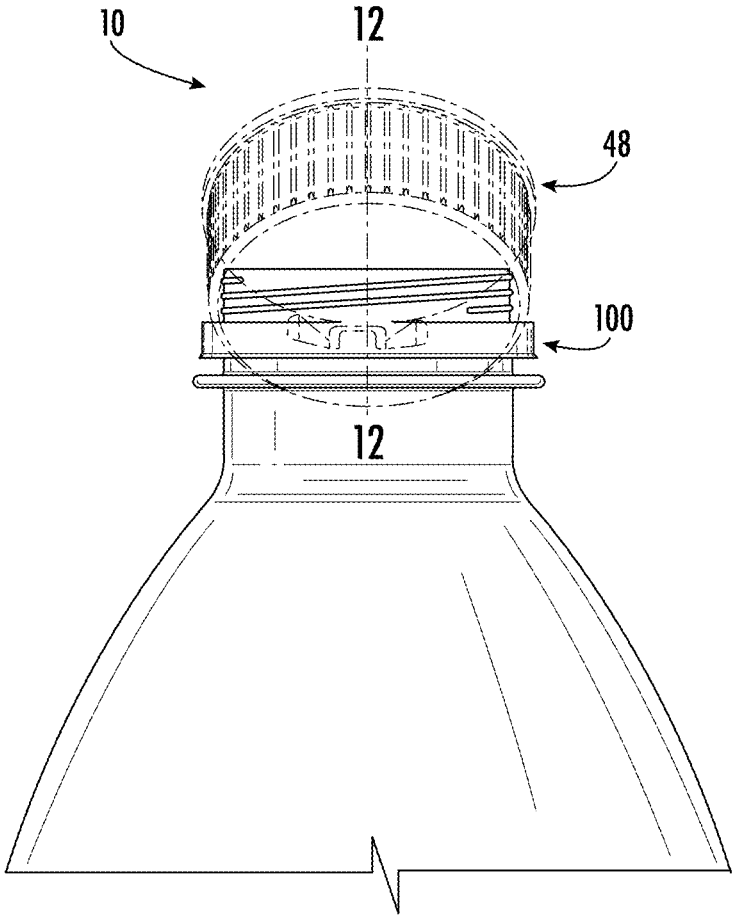
FIG. 11 is a back view of the closure of FIG. 1 on a container shown in a different configuration than shown in FIG. 9, according to an exemplary embodiment.
Figure 12:
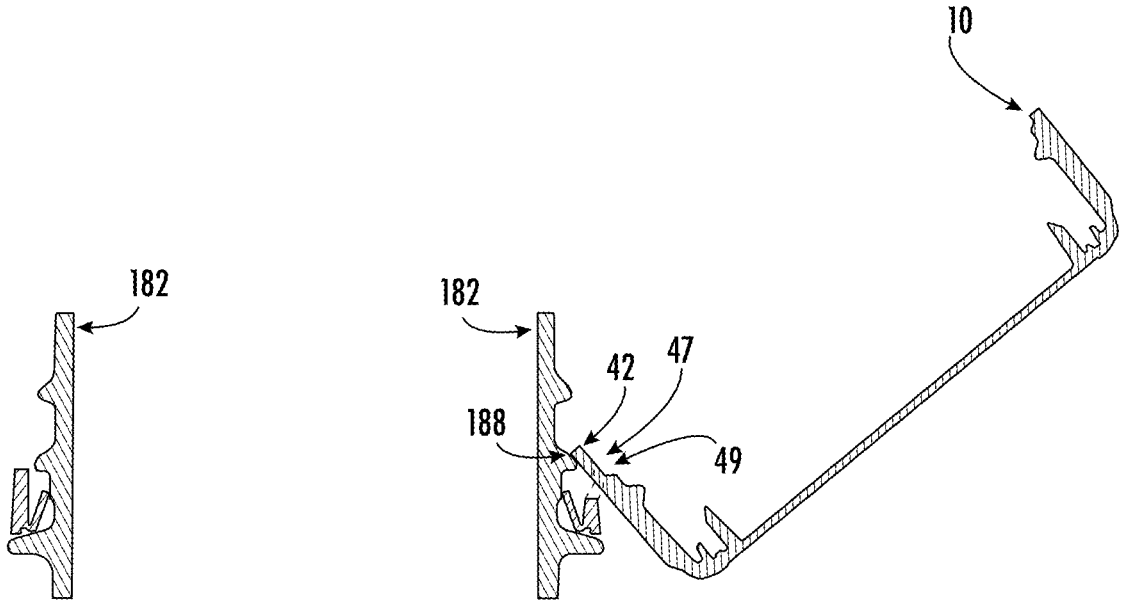
FIG. 12 is a cross-section view of the closure of FIG. 11 on a container taken along line 12-12 in FIG. 11, according to an exemplary embodiment.
Figure 13:
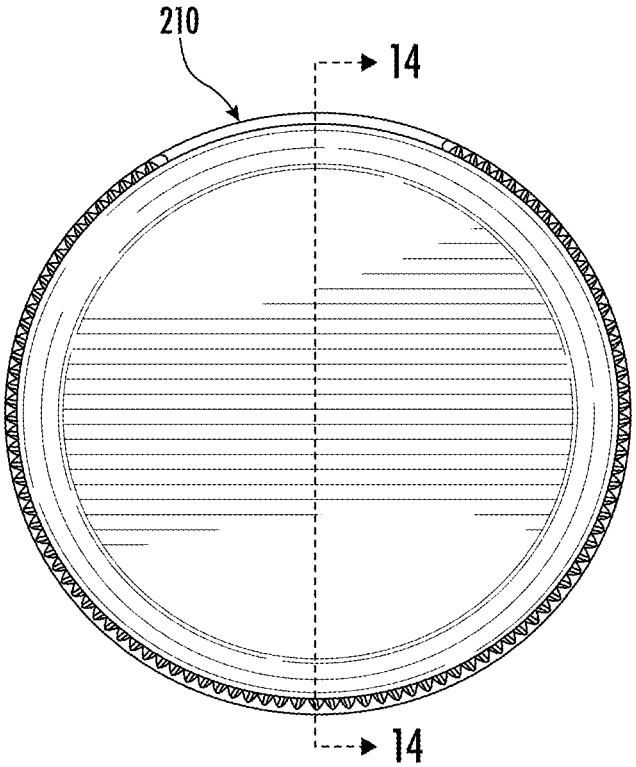
FIG. 13 is a top view of a closure, according to an exemplary embodiment.
Figure 14:
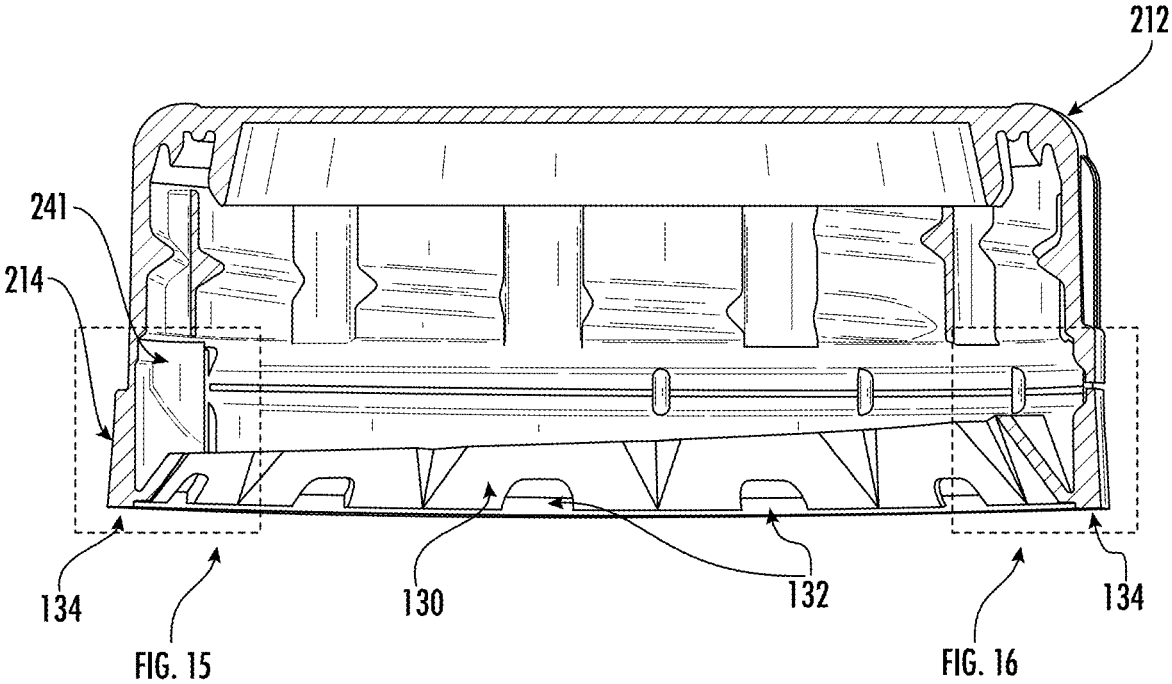
FIG. 14 is a cross-section view of the closure of FIG. 13 taken along line 14-14 in FIG. 13.
Figure 15:
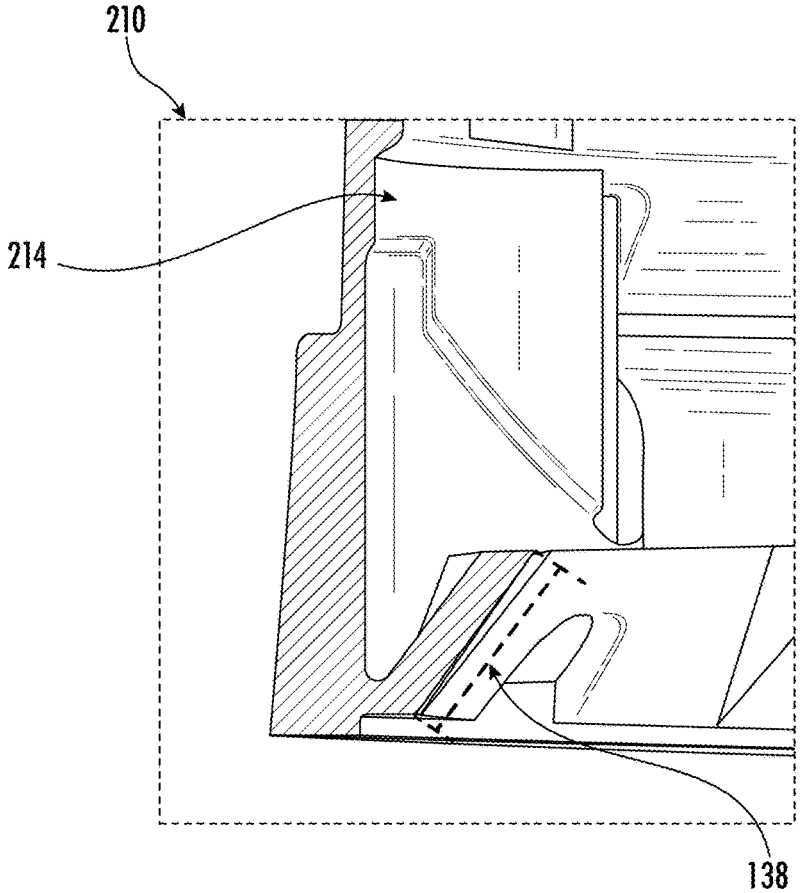
FIG. 15 is a detailed cross-section view of the closure of FIG. 13 identified in FIG. 14.
Figure 16:
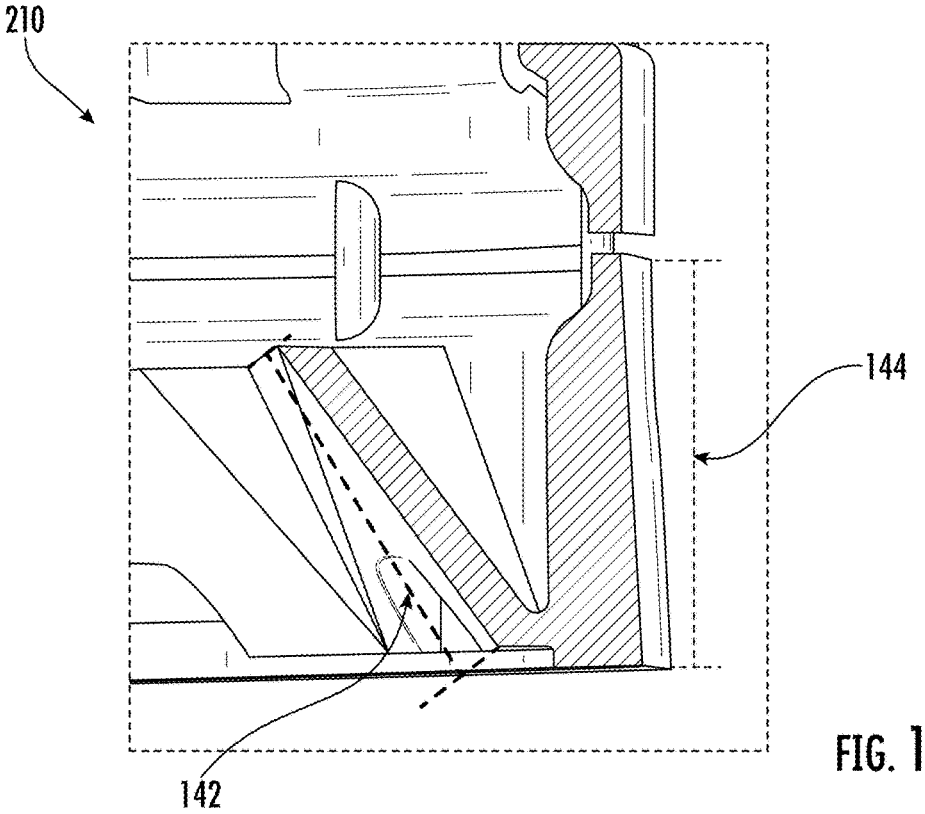
FIG. 16 is a detailed cross-section view of the closure of FIG. 13 identified in FIG. 14.

Turning to FIGS. 11-12, body 48 of closure 10 is pivoted to the open position. Tab 42 is now interfacing against the upper portion of annular projection 188 of container 180. Tab 42 interfacing against annular projection 188 of container 180 biases body 48 of closure 10 away from neck portion 182. Similar to FIGS. 5-10, left tether 47 and right tether 49 retain the coupling between body 48 and retaining band 100 and are shown in dotted line in FIG. 12 because they are not located along the cross-section line identified in FIG. 1.

Turning to FIGS. 13-16, various aspects of closure 210 and retaining band 214 are shown. Closure 210 is similar to closure 10 and the other closures except as described herein. Similarly, retaining band 214 in closure 210 is similar to retaining band 100 in closure 10 except as described herein. It is contemplated herein that retaining band 214 may be incorporated with any of the closures described herein.

Interference band 130 extends from retaining band 214 and includes a tapered formation that facilitates the body of the closure pivoting away from interference band 130, particularly when the closure includes a hinged, tethered formation that couples the body of the closure to the retaining band. Interference band 130 extends inwards from base 134 of retention band 214. Interference band 214 defines one or more apertures 132.

Interference band 214 extends a varying distance from base 134 at different circumferential positions with respect to axis 8. At the one or more locations below hinge 60 (see FIG. 15), interference band 214 has length 138. At the one or more locations opposite hinge 891 with respect to rotational axis 8 (see FIG. 16), interference band 214 has length 142, which is longer than length 138. In a specific embodiment, base 134 defines distance 144 between top of retaining band 214 at the weakened section, shown as line of weakness 34, and base 134 of retention band 214. In a specific embodiment, length 138 is less than 75% of length 142, and more specifically less than 60% of length 142, and even more specifically length 138 is less than 50% of distance 144.

Figure 17:
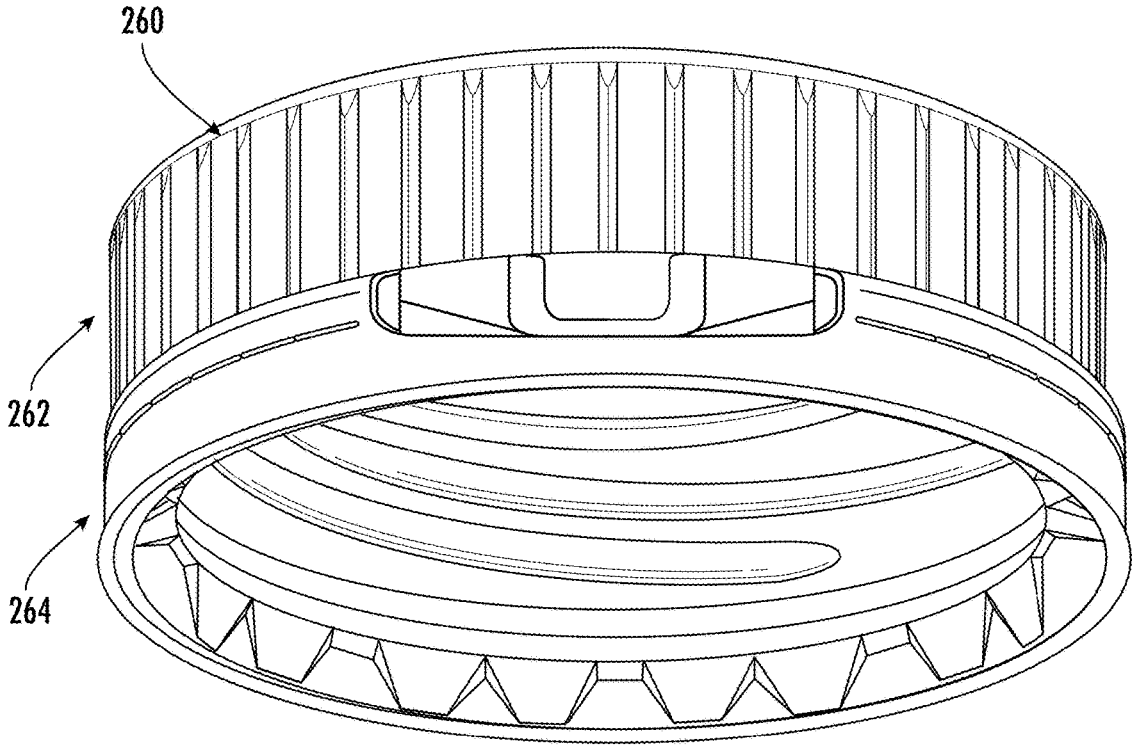
FIG. 17 is a perspective view of a closure, according to an exemplary embodiment.
Figure 18:
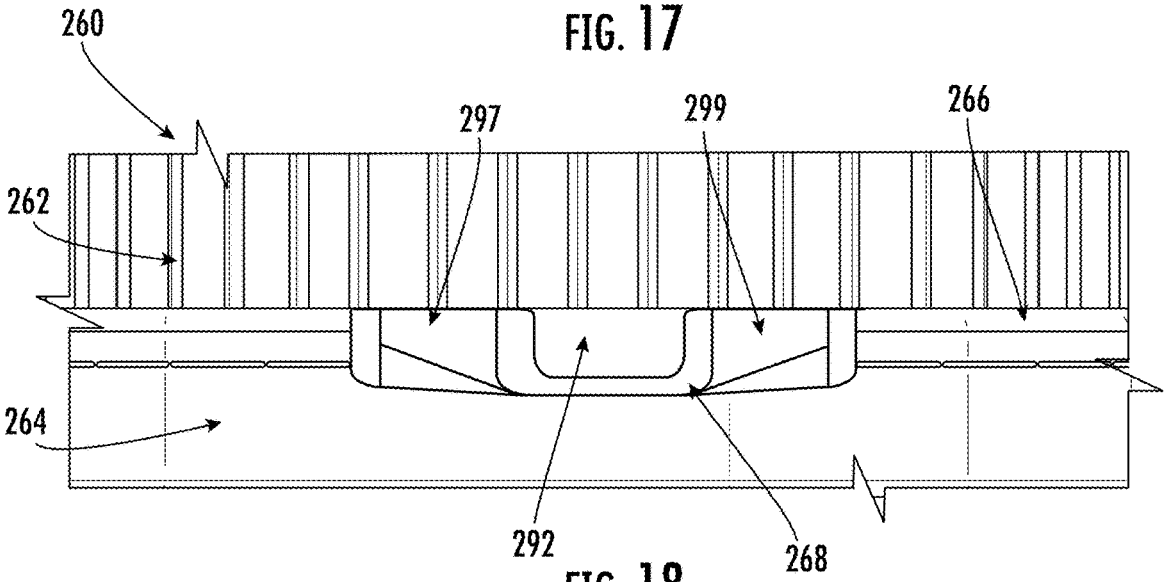
FIG. 18 is a detailed back view of the closure of FIG. 17, according to an exemplary embodiment.

Turning to FIGS. 17-18, various aspects of closure 260 are shown. Closure 260 is similar to closure 10 and the other closures except as described herein. Body 262 of closure 260 is separated from retaining band 264 by upper band of weakness 266. Body 262 is pivotally coupled to retaining band 264 via left and right tethers 297, 299. Left and right tethers 297, 299 extend between retaining band 264 and body 262. Tab 292 extends from body 262 away from top panel of closure 360. Tab 292 is defined by aperture 268, which extends around and defines tab 292.

Figure 19:
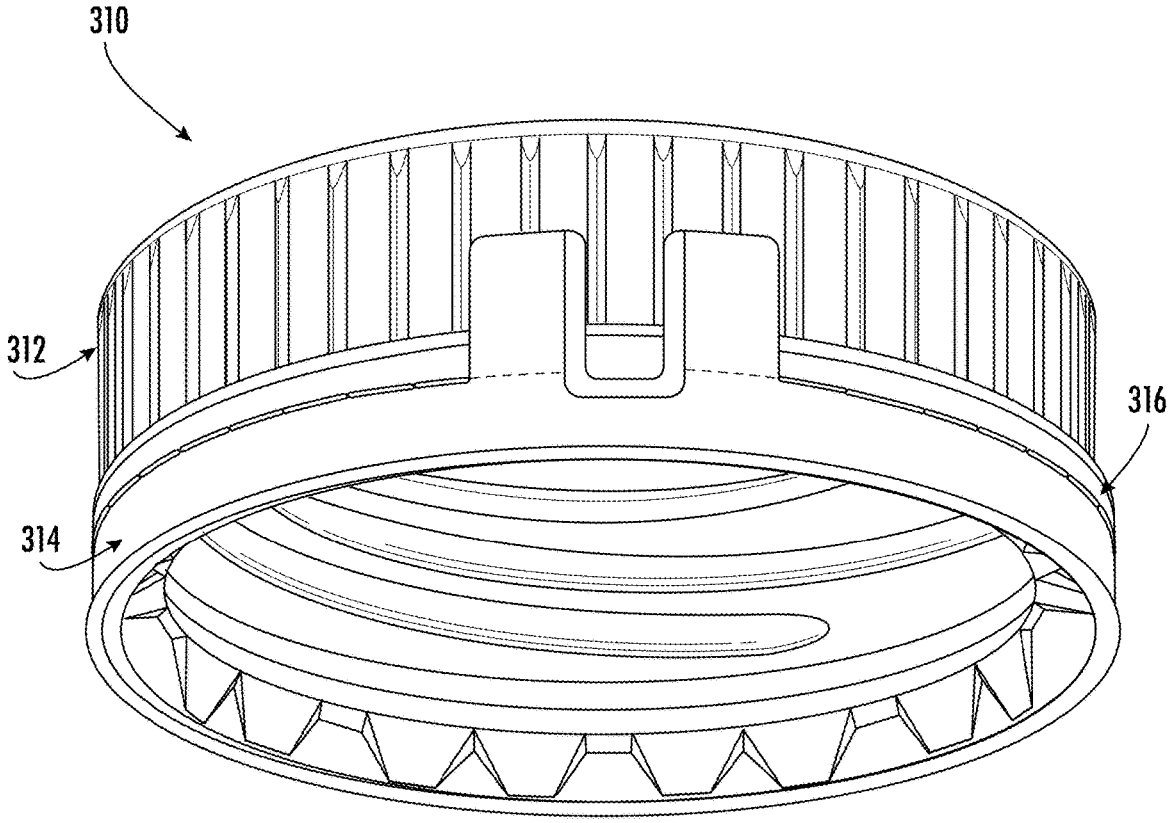
FIG. 19 is a perspective view of a closure, according to an exemplary embodiment.
Figure 20:
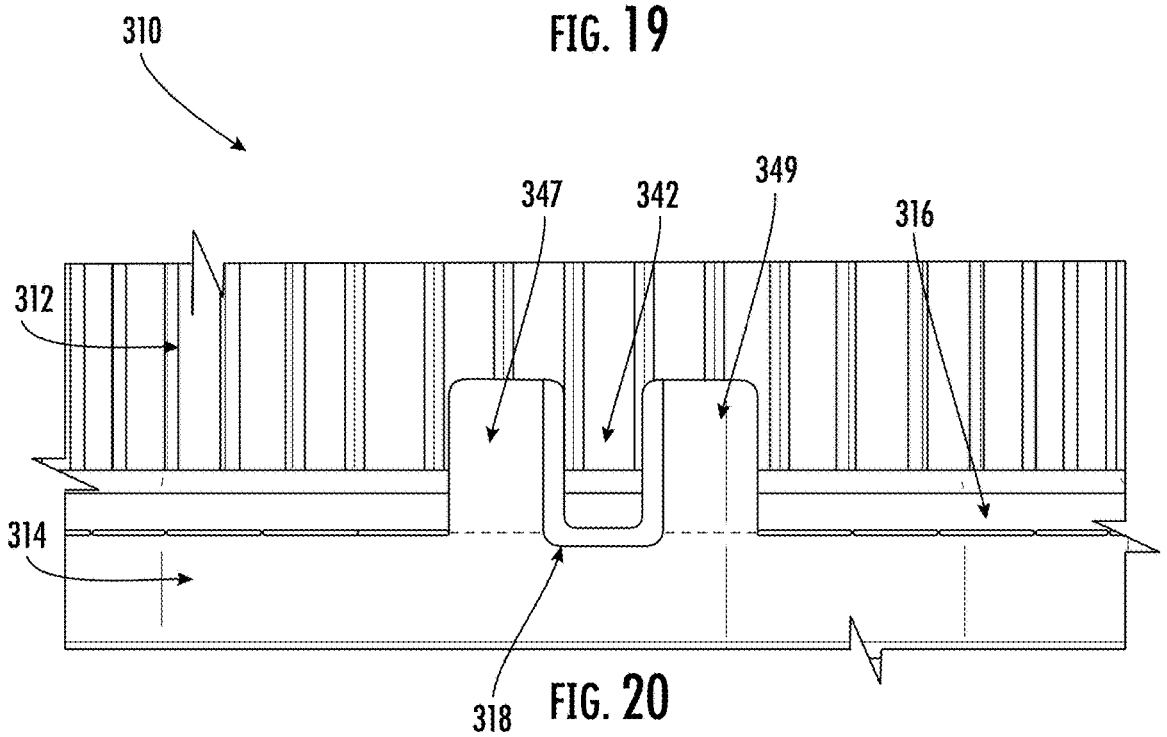
FIG. 20 is a detailed back view of the closure of FIG. 19, according to an exemplary embodiment.

Turning to FIGS. 19-20, various aspects of closure 310 are shown. Closure 310 is similar to closure 10 and the other closures except as described herein. Body 312 of closure 310 is separated from retaining band 314 by upper band of weakness 316. Body 312 is pivotally coupled to retaining band 314 via left and right tethers 347, 349. Left and right tethers 347, 349 extend between retaining band 314 and body 312. Tab 342 extends from body 312 away from top panel of closure 310. Tab 342 is defined by aperture 318, which extends around and defines tab 342.

Figure 21:
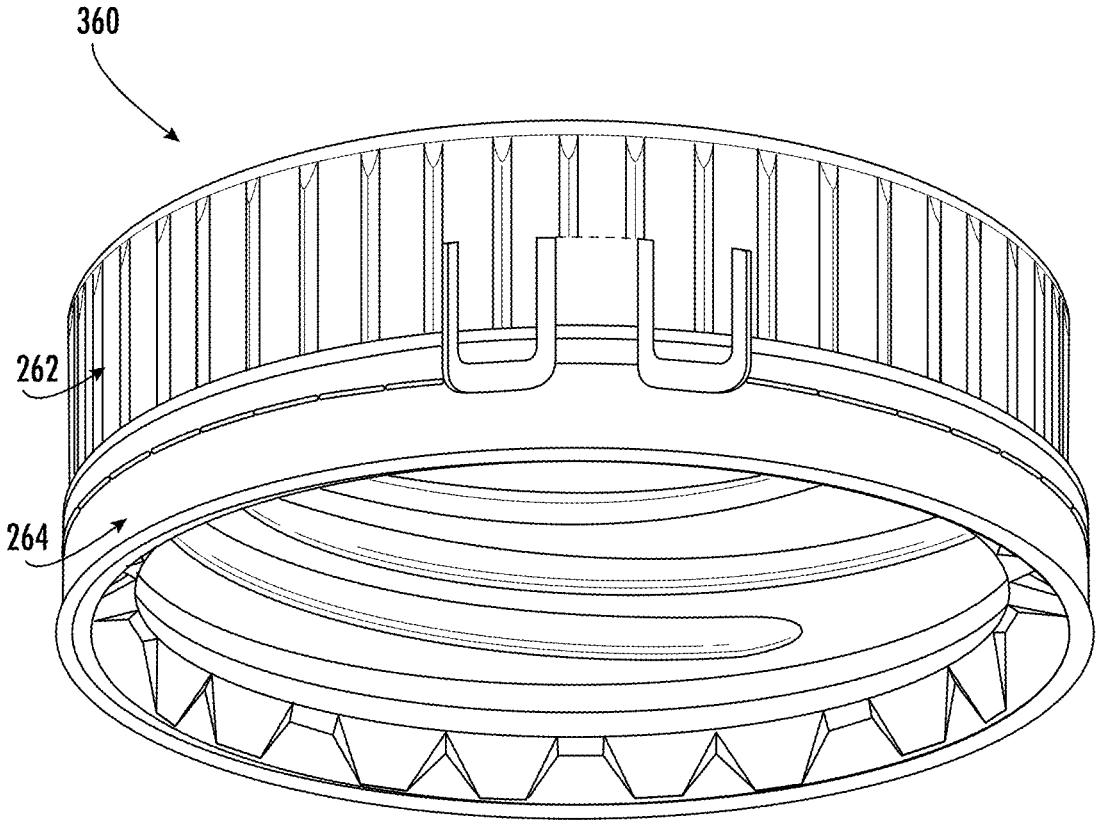
FIG. 21 is a perspective view of a closure, according to an exemplary embodiment.
Figure 22:
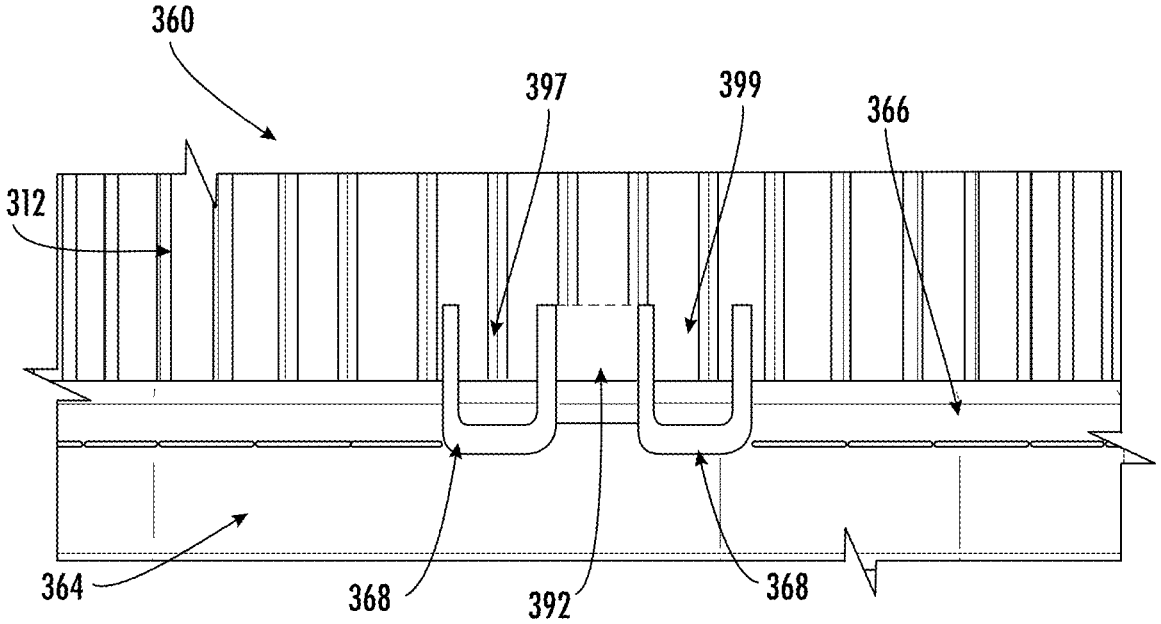
FIG. 22 is a detailed back view of the closure of FIG. 21, according to an exemplary embodiment.

Turning to FIGS. 21-22, various aspects of closure 360 are shown. Closure 360 is similar to closure 10 and the other closures except as described herein. Body 362 of closure 360 is separated from retaining band 364 by upper band of weakness 366. Body 362 is pivotally coupled to retaining band 364 via left and right tethers 397, 399. Left and right tethers 397, 399 extend between retaining band 364 and body 362. Tab 392 extends from body 362 away from top panel of closure 360. Tab 392 is defined by apertures 368, which extend around and defines tab 392.

Figure 23:
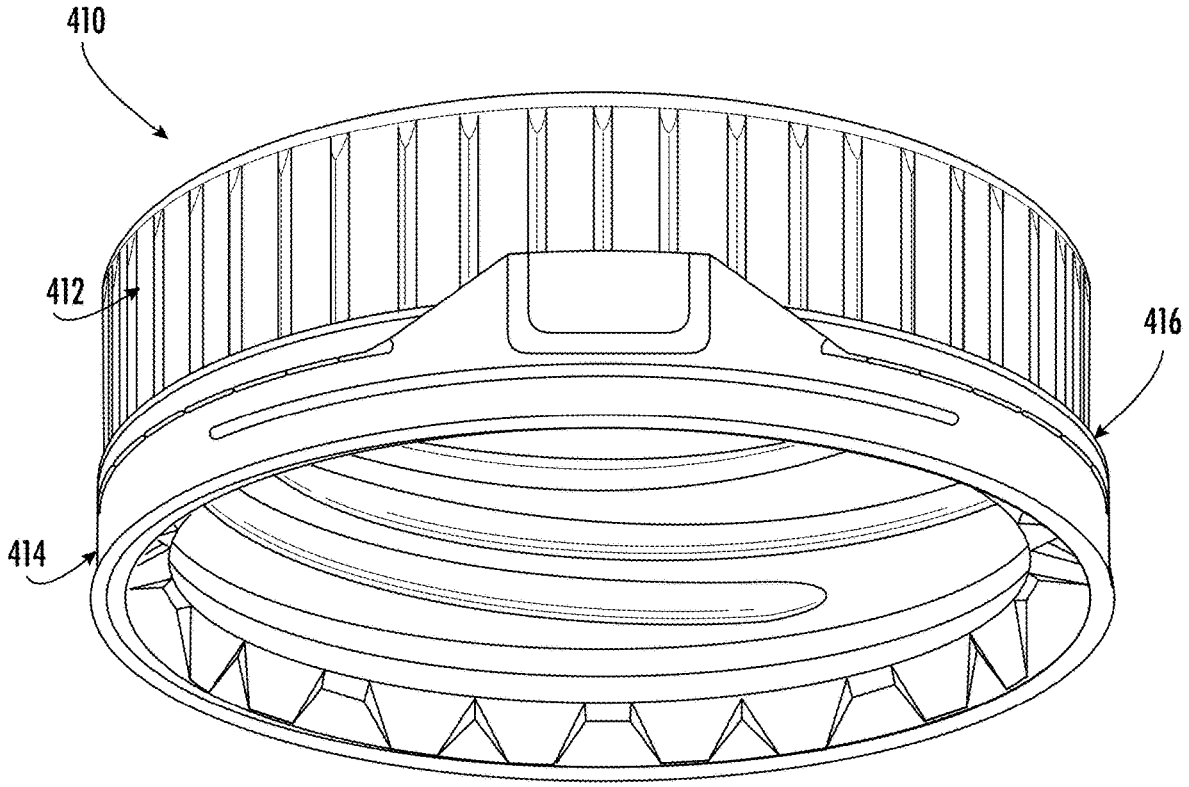
FIG. 23 is a perspective view of a closure, according to an exemplary embodiment.
Figure 24:
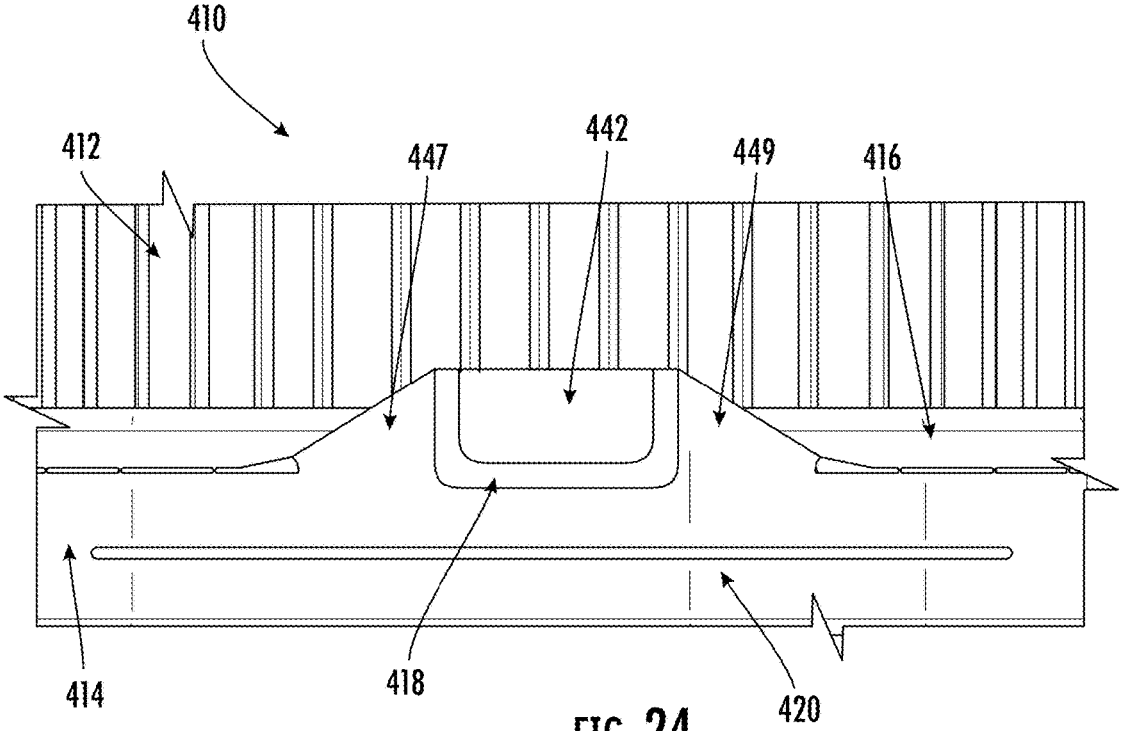
FIG. 24 is a detailed back view of the closure of FIG. 23, according to an exemplary embodiment.

Turning to FIGS. 23-24, various aspects of closure 410 are shown. Closure 410 is similar to closure 10 and the other closures except as described herein. Body 412 of closure 410 is separated from retaining band 464 by upper band of weakness 416. Body 412 is pivotally coupled to retaining band 414 via left and right tethers 447, 449. Left and right tethers 447, 449 extend between retaining band 414 and body 412. Tab 442 extends from body 412 away from top panel of closure 410. Tab 442 is defined by aperture 418, which extends around and defines tab 442. Each end of upper band of weakness 416 includes a triangular opening that broadens closer to the tab 442. Closure 410 includes lower band of weakness, shown as band 420. In a specific embodiment, closure 410 is molded with band 420 included (e.g., band 420 is not subsequently slit into closure 410). In a specific embodiment, tab 442 is located between band 420 and the top panel of the closure.

Figure 25:
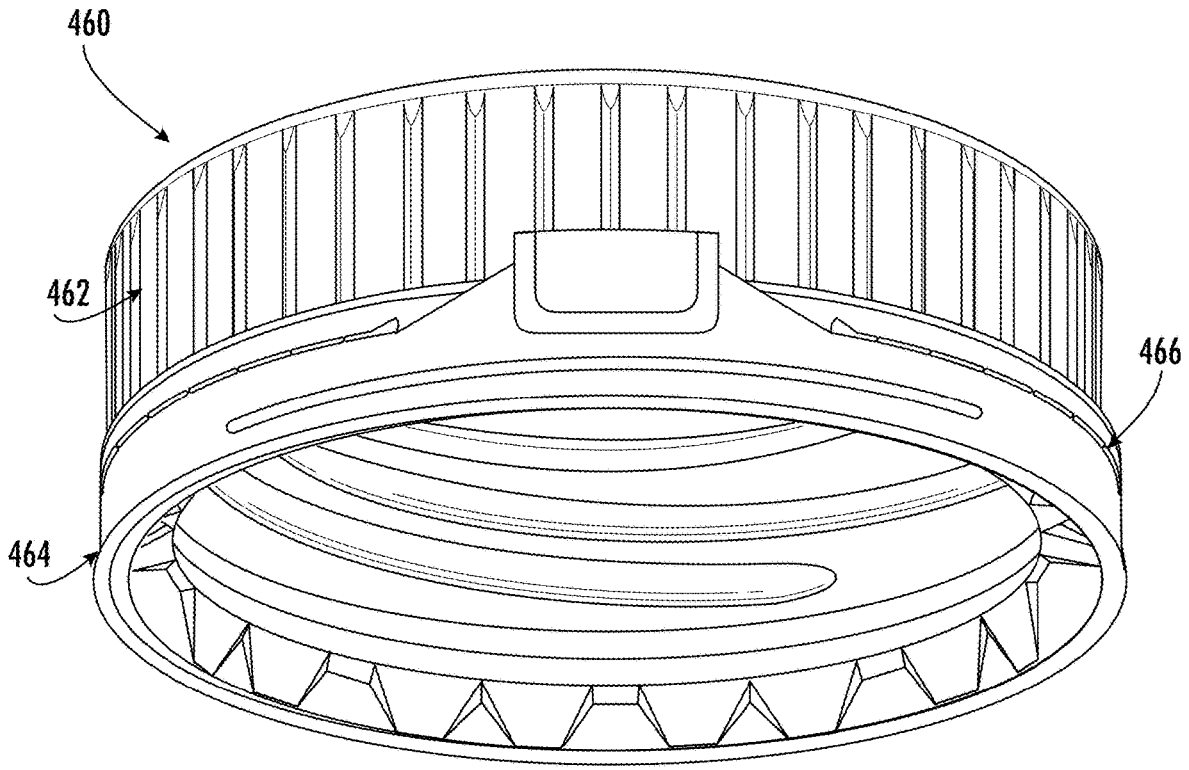
FIG. 25 is a perspective view of a closure, according to an exemplary embodiment.
Figure 26:
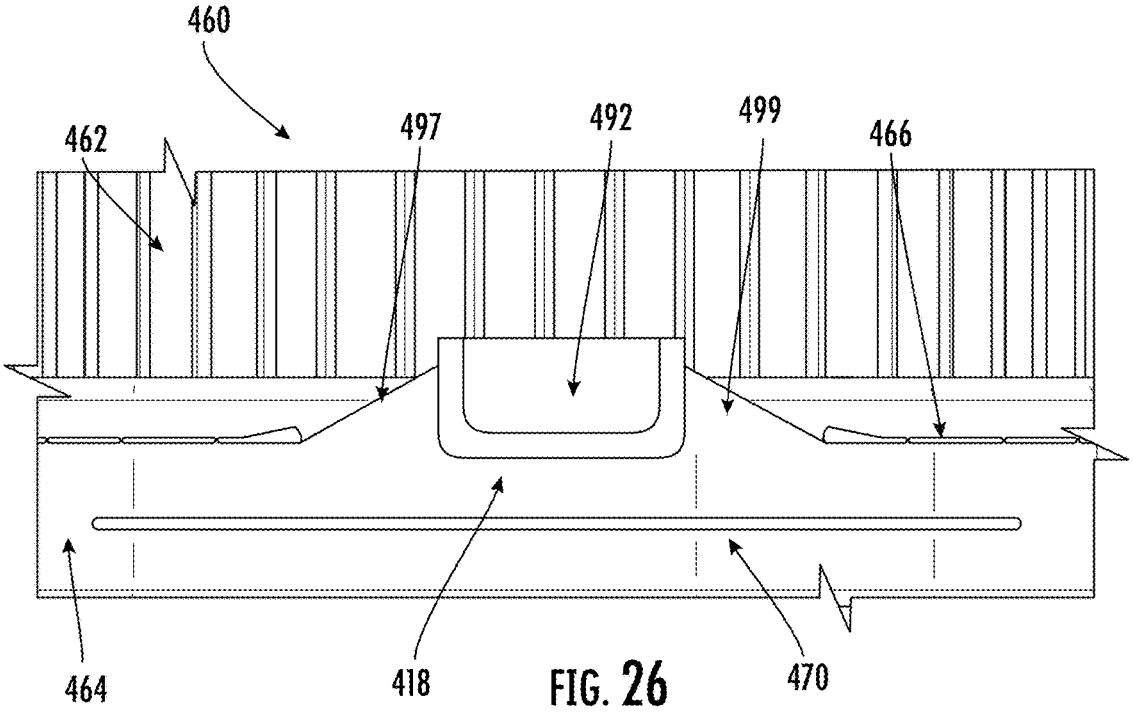
FIG. 26 is a detailed back view of the closure of FIG. 25, according to an exemplary embodiment.

Turning to FIGS. 25-26, various aspects of closure 460 are shown. Closure 460 is similar to closure 10 and the other closures except as described herein. Body 462 of closure 460 is separated from retaining band 464 by upper band of weakness 466. Body 462 is pivotally coupled to retaining band 464 via left and right tethers 497, 499. Left and right tethers 497, 499 extend between retaining band 464 and body 462. Tab 492 extends from body 462 away from top panel of closure 460. Tab 492 is defined by aperture 468, which extends around and defines tab 492. Each end of upper band of weakness 446 includes a triangular opening that broadens closer to the tab 492. Closure 460 includes lower band of weakness, shown as band 470. In a specific embodiment, closure 460 is molded with band 470 included.

Figure 27:
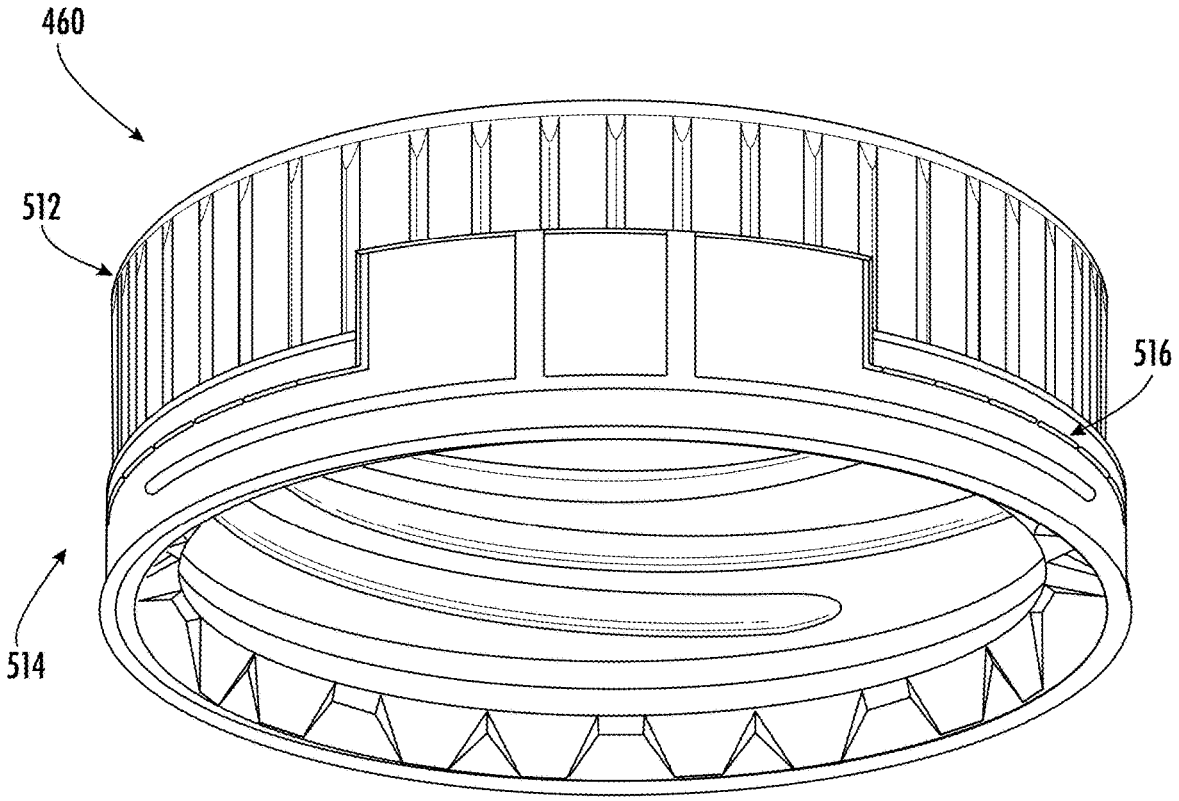
FIG. 27 is a perspective view of a closure, according to an exemplary embodiment.
Figure 28:
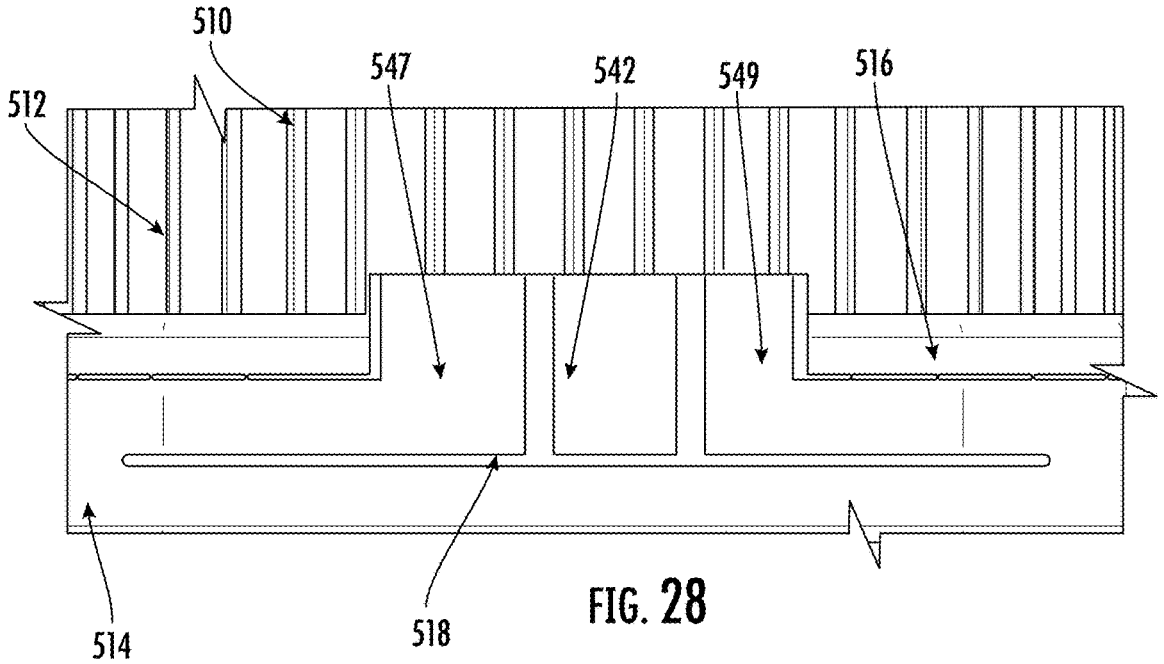
FIG. 28 is a detailed back view of the closure of FIG. 27, according to an exemplary embodiment.

Turning to FIGS. 27-28, various aspects of closure 510 are shown. Closure 510 is similar to closure 10 and the other closures except as described herein. Body 512 of closure 510 is separated from retaining band 564 by upper band of weakness 516. Body 512 is pivotally coupled to retaining band 514 via left and right tethers 547, 549. Left and right tethers 547, 549 extend between retaining band 514 and body 512. Tab 542 extends from body 512 away from top panel of closure 510. Tab 542 is defined by aperture 518, which extends around and defines tab 542. As will be observed, aperture 518 includes a lower portion that extends circumferentially around closure, and two vertical portions that extend from the lower portion towards the top panel.

Figure 29:
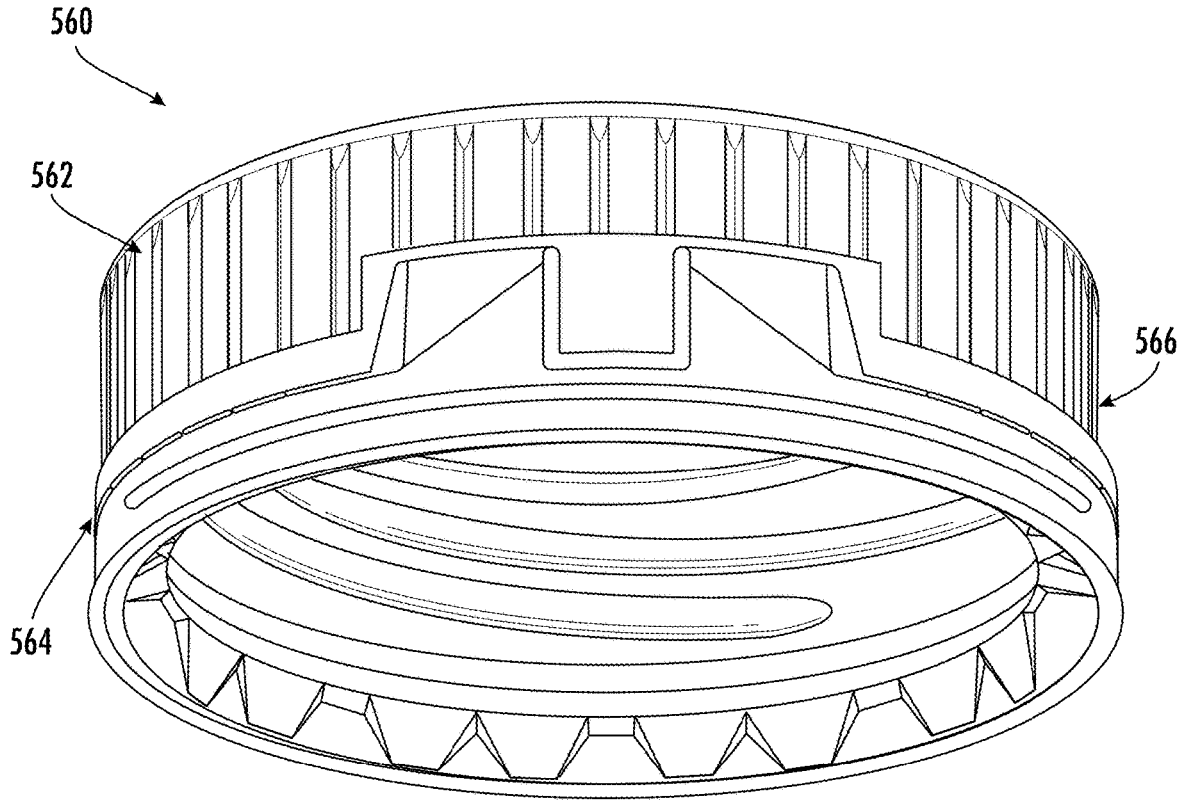
FIG. 29 is a perspective view of a closure, according to an exemplary embodiment.
Figure 30:
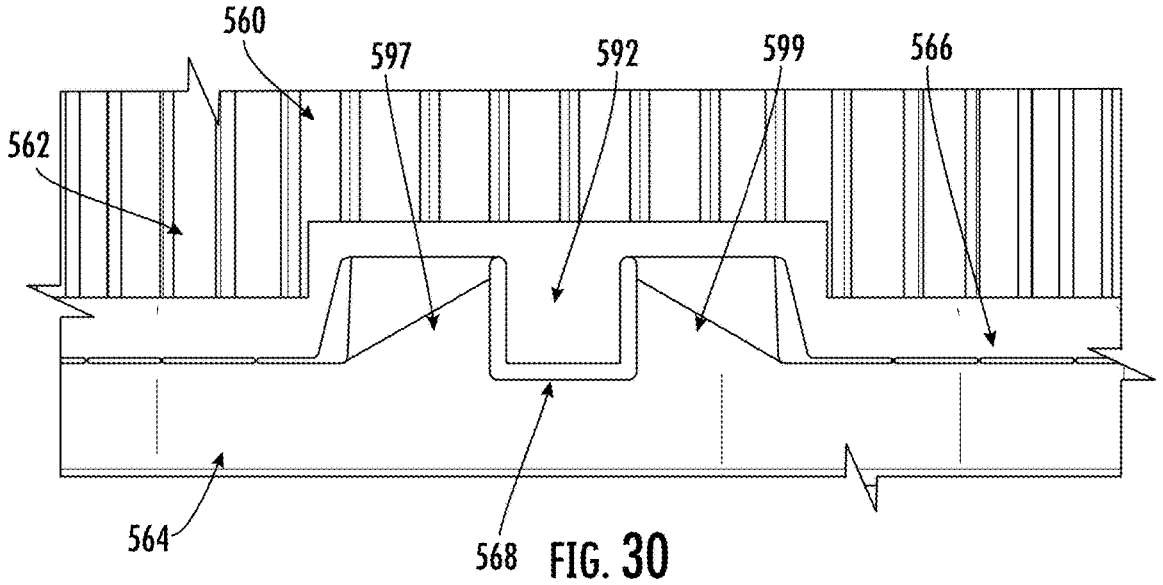
FIG. 30 is a detailed back view of the closure of FIG. 29, according to an exemplary embodiment.

Turning to FIGS. 29-30, various aspects of closure 560 are shown. Closure 560 is similar to closure 10 and the other closures except as described herein. Body 562 of closure 560 is separated from retaining band 564 by upper band of weakness 566. Body 562 is pivotally coupled to retaining band 564 via left and right tethers 597, 599. Left and right tethers 597, 599 extend between retaining band 564 and body 562. Tab 592 extends from body 562 away from top panel of closure 560. Tab 592 is defined by aperture 568, which extends around and defines tab 592. Each end of upper band of weakness 566 includes a triangular opening that broadens closer to the tab 592.

Figure 31:
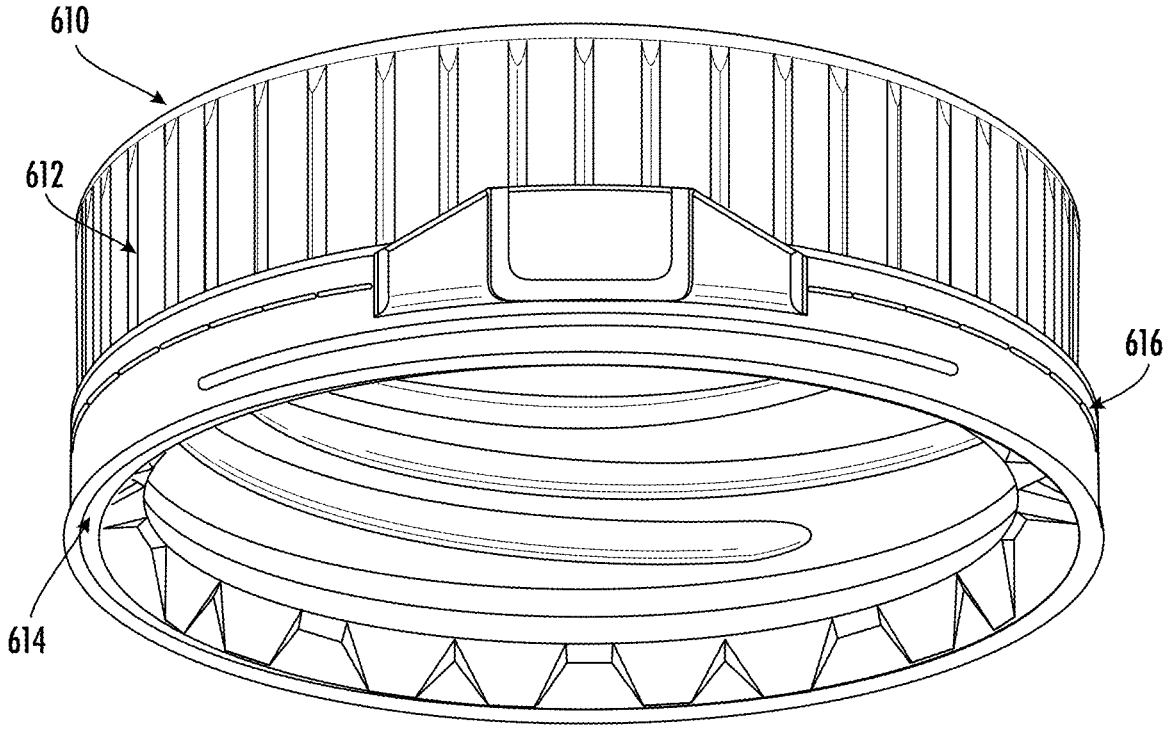
FIG. 31 is a perspective view of a closure, according to an exemplary embodiment.
Figure 32:
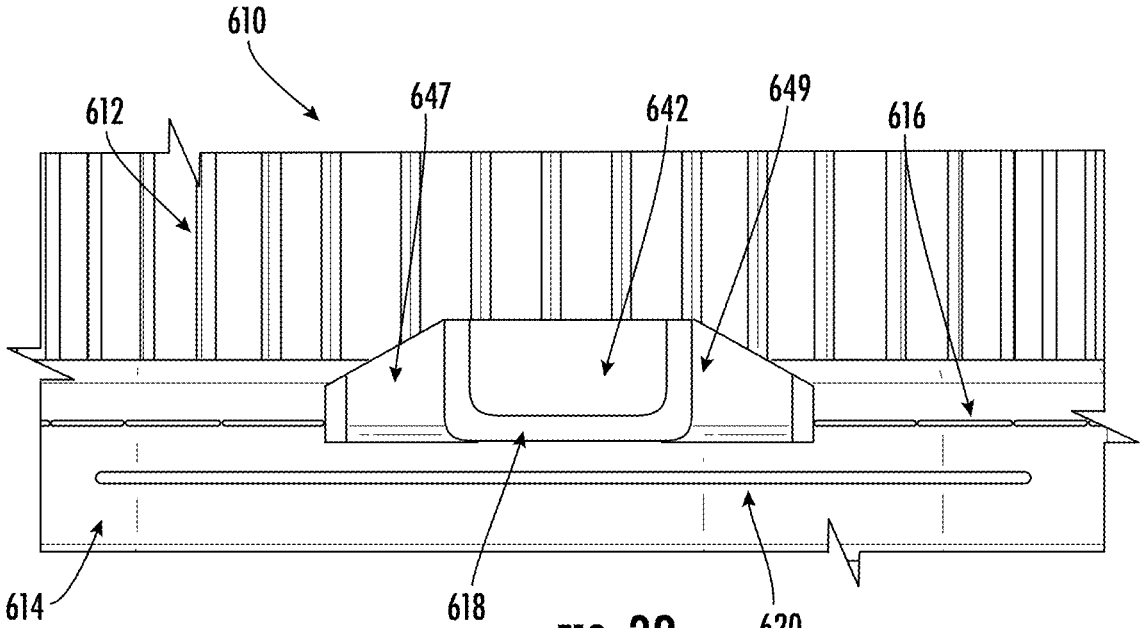
FIG. 32 is a detailed back view of the closure of FIG. 31, according to an exemplary embodiment.

Turning to FIGS. 31-32, various aspects of closure 610 are shown. Closure 610 is similar to closure 10 and the other closures except as described herein. Body 612 of closure 610 is separated from retaining band 664 by upper band of weakness 616. Body 612 is pivotally coupled to retaining band 614 via left and right tethers 647, 649. Left and right tethers 647, 649 extend between retaining band 614 and body 612. Tab 642 extends from body 612 away from top panel of closure 610. Tab 642 is defined by aperture 618, which extends around and defines tab 642. Closure 610 includes lower band of weakness, shown as band 620. In a specific embodiment, closure 610 is molded with band 620.

Figure 33:
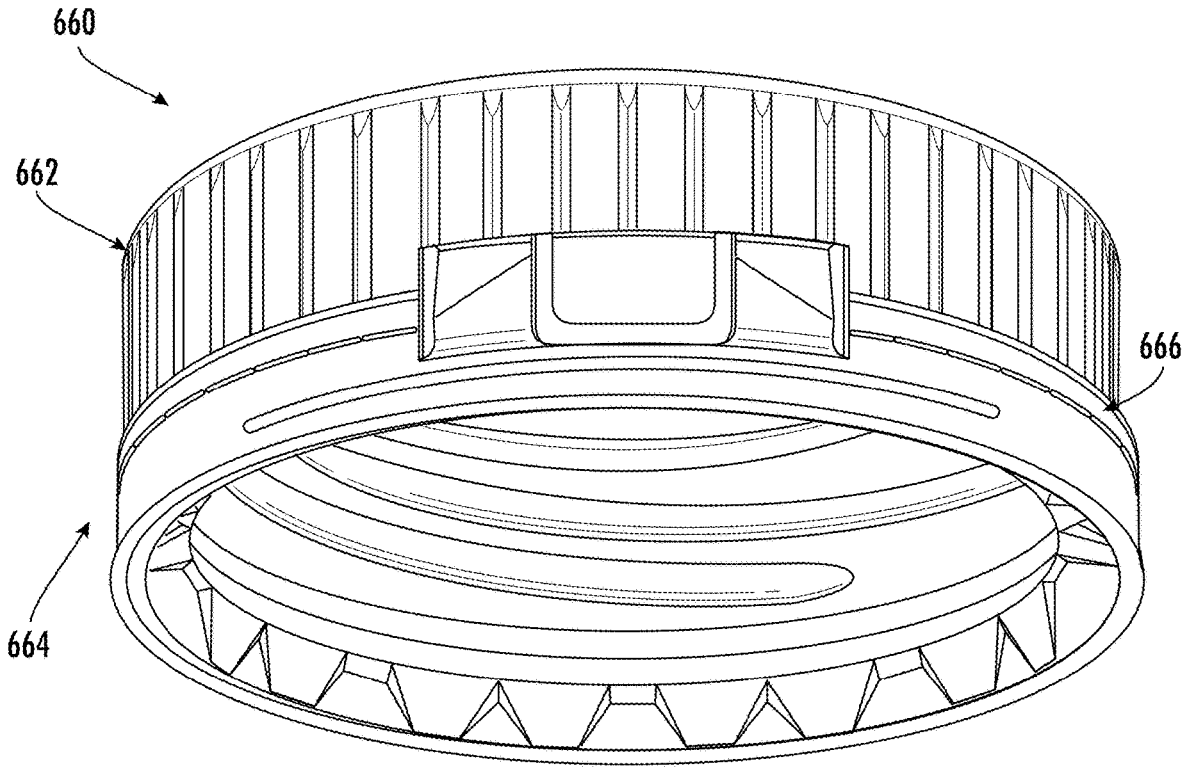
FIG. 33 is a perspective view of a closure, according to an exemplary embodiment.
Figure 34:
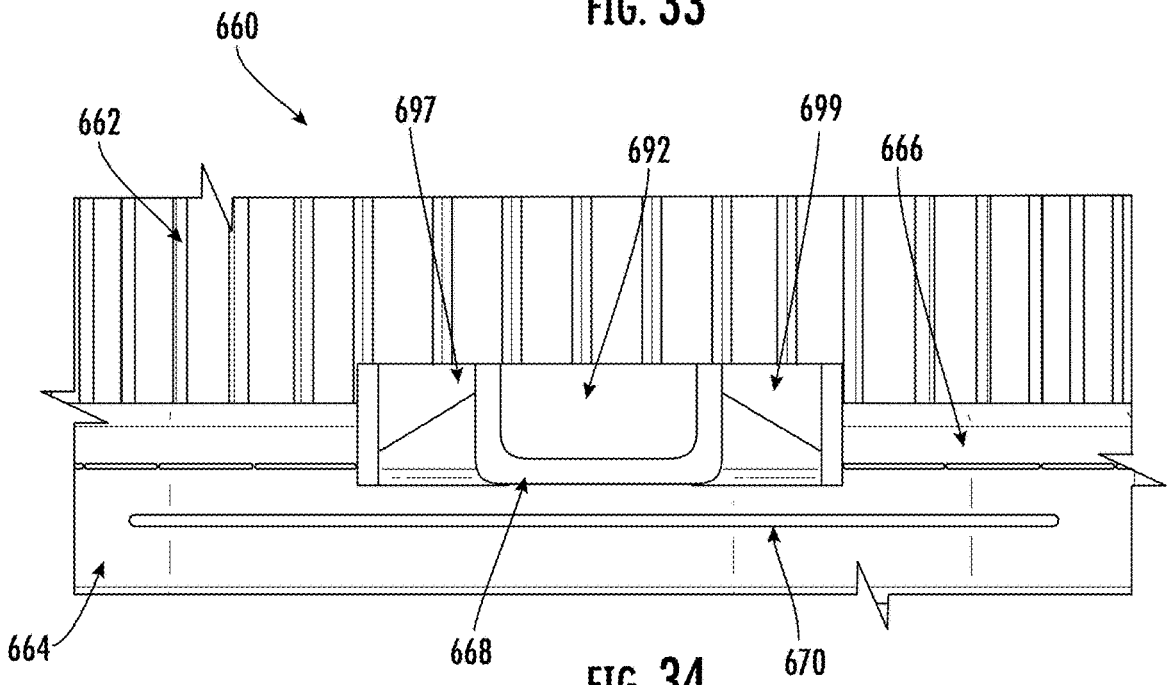
FIG. 34 is a detailed back view of the closure of FIG. 33, according to an exemplary embodiment.

Turning to FIGS. 33-34, various aspects of closure 660 are shown. Closure 660 is similar to closure 10 and the other closures except as described herein. Body 662 of closure 660 is separated from retaining band 664 by upper band of weakness 666. Body 662 is pivotally coupled to retaining band 664 via left and right tethers 697, 699. Left and right tethers 697, 699 extend between retaining band 664 and body 662. Tab 692 extends from body 662 away from top panel of closure 660. Tab 692 is defined by aperture 668, which extends around and defines tab 692. Closure 660 includes lower band of weakness, shown as band 670. In a specific embodiment, closure 660 is molded with band 670.

Figure 35:
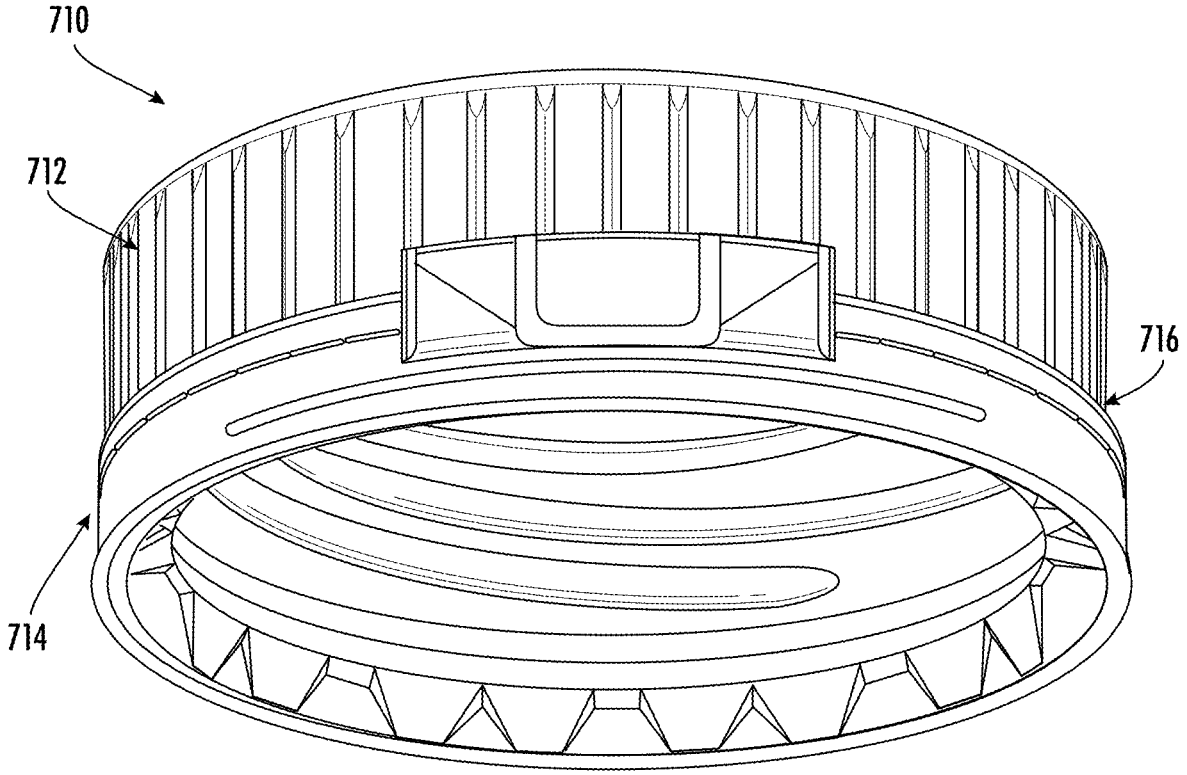
FIG. 35 is a perspective view of a closure, according to an exemplary embodiment.
Figure 36:
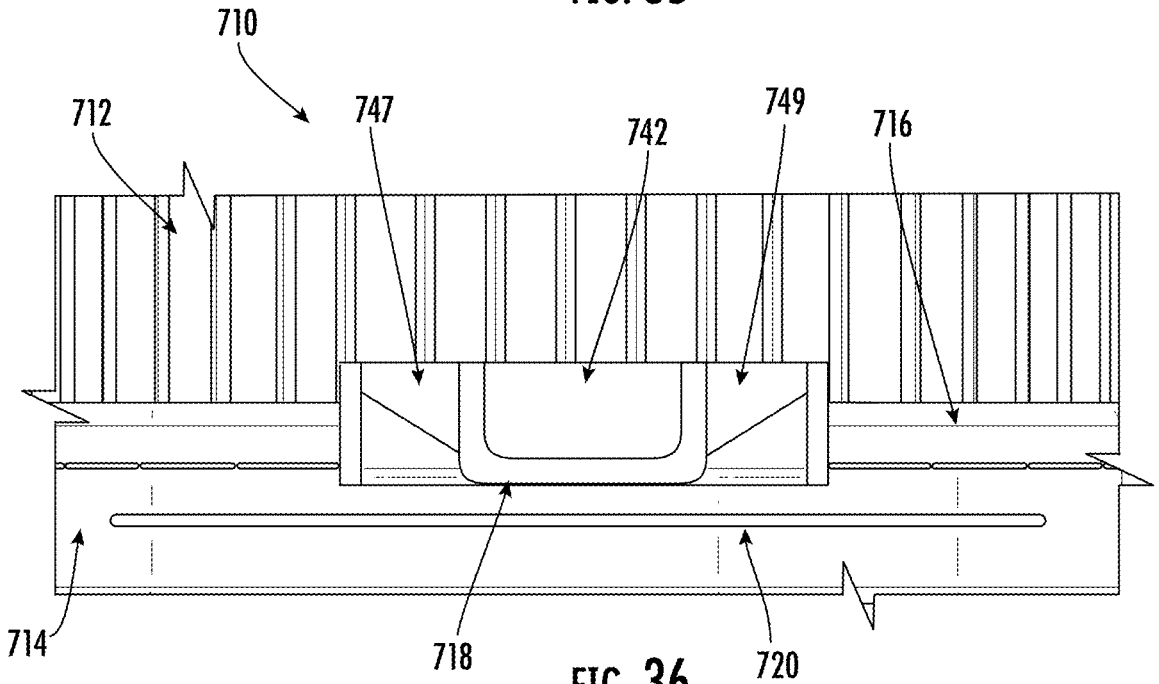
FIG. 36 is a detailed back view of the closure of FIG. 35, according to an exemplary embodiment.

Turning to FIGS. 35-36, various aspects of closure 710 are shown. Closure 710 is similar to closure 10 and the other closures except as described herein. Body 712 of closure 710 is separated from retaining band 764 by upper band of weakness 716. Body 712 is pivotally coupled to retaining band 714 via left and right tethers 747, 749. Left and right tethers 747, 749 extend between retaining band 714 and body 712. Tab 742 extends from body 712 away from top panel of closure 710. Tab 742 is defined by aperture 718, which extends around and defines tab 742. Closure 710 includes lower band of weakness, shown as band 720. In a specific embodiment, closure 710 is molded with band 720.

Figure 37:
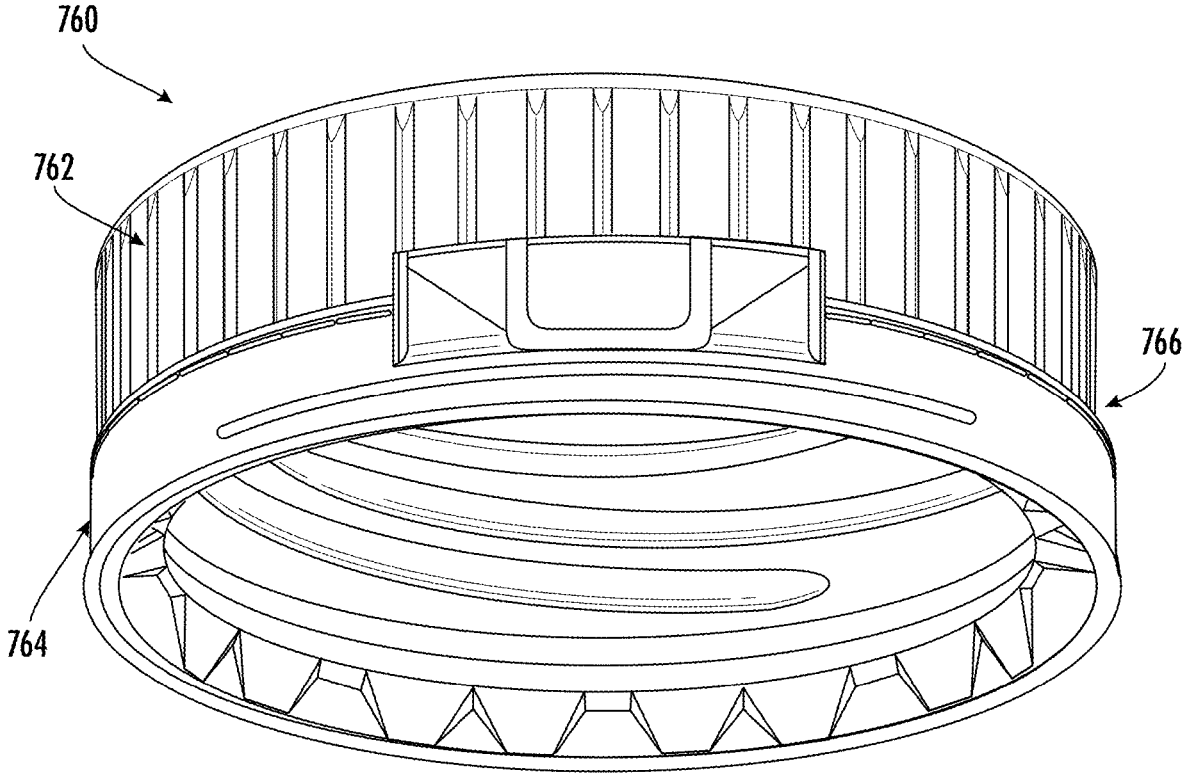
FIG. 37 is a perspective view of a closure, according to an exemplary embodiment.
Figure 38:
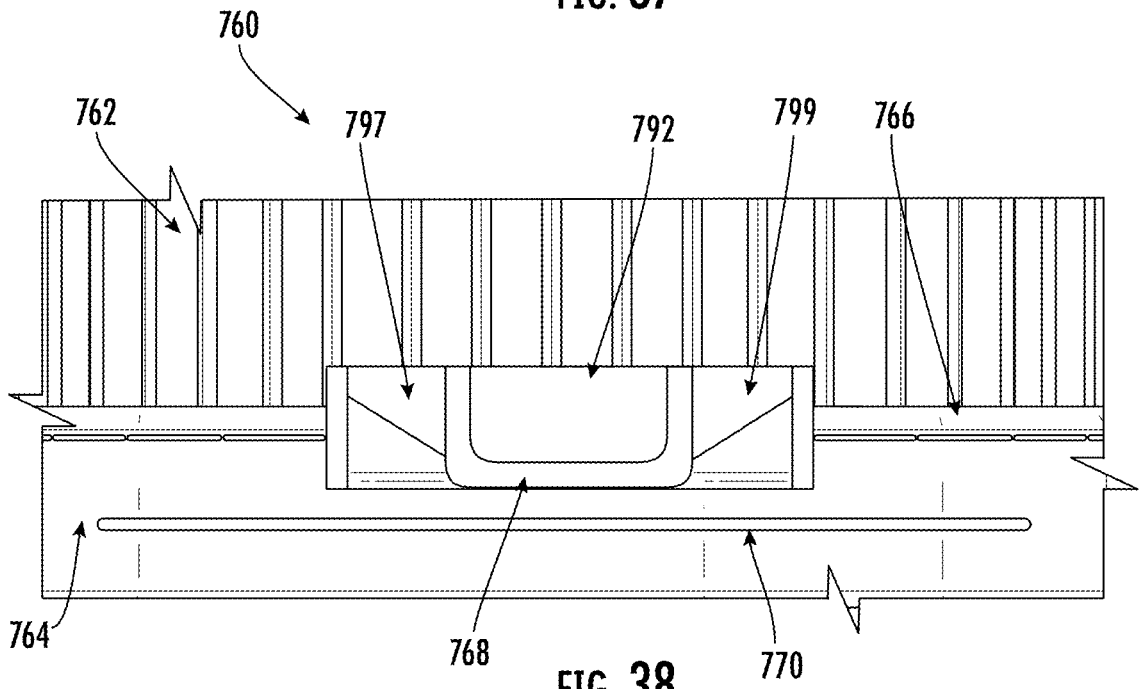
FIG. 38 is a detailed back view of the closure of FIG. 37, according to an exemplary embodiment.

Turning to FIGS. 37-38, various aspects of closure 760 are shown. Closure 760 is similar to closure 10 and the other closures except as described herein. Body 762 of closure 760 is separated from retaining band 764 by upper band of weakness 766. Body 762 is pivotally coupled to retaining band 764 via left and right tethers 797, 799. Left and right tethers 797, 799 extend between retaining band 764 and body 762. Tab 792 extends from body 762 away from top panel of closure 760. Tab 792 is defined by aperture 768, which extends around and defines tab 792. Closure 760 includes lower band of weakness, shown as band 770. In a specific embodiment, closure 760 is molded with band 770.

Figure 39:
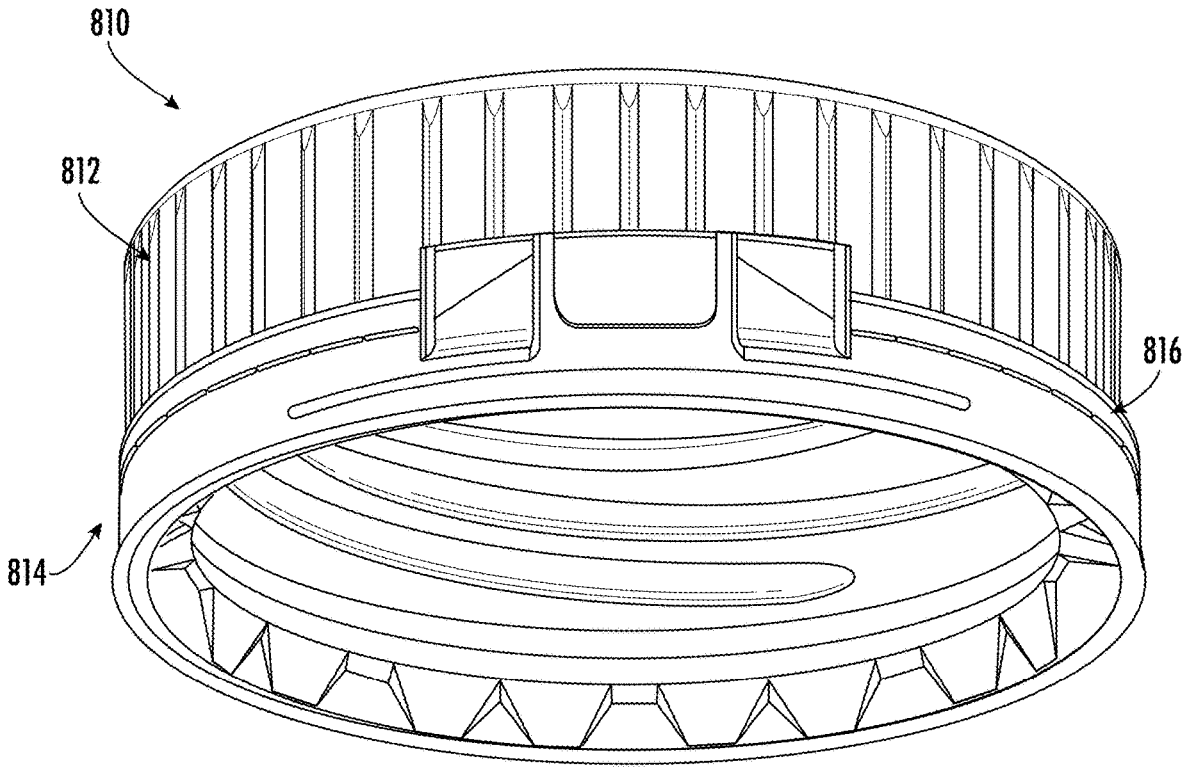
FIG. 39 is a perspective view of a closure, according to an exemplary embodiment.
Figure 40:
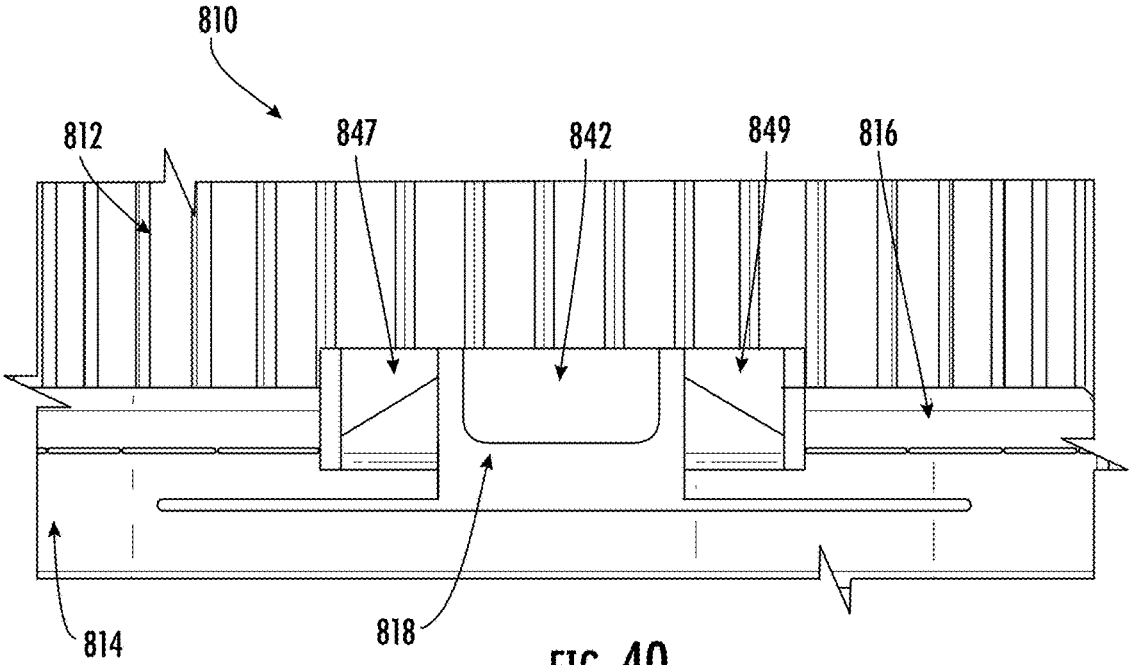
FIG. 40 is a detailed back view of the closure of FIG. 39, according to an exemplary embodiment.

Turning to FIGS. 39-40, various aspects of closure 810 are shown. Closure 810 is similar to closure 10 and the other closures except as described herein. Body 812 of closure 810 is separated from retaining band 864 by upper band of weakness 816. Body 812 is pivotally coupled to retaining band 814 via left and right tethers 847, 849. Left and right tethers 847, 849 extend between retaining band 814 and body 812. Tab 842 extends from body 812 away from top panel of closure 810. Tab 842 is defined by aperture 818, which extends around and defines tab 842.

Figure 41:
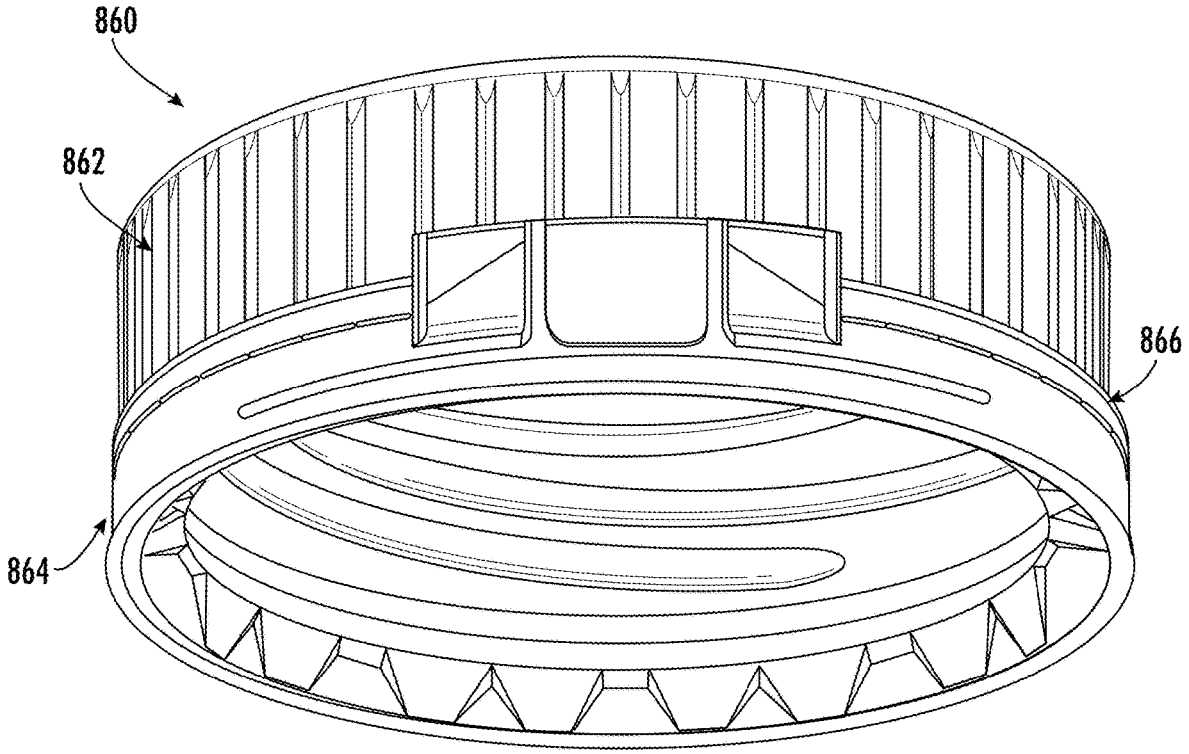
FIG. 41 is a perspective view of a closure, according to an exemplary embodiment.
Figure 42:
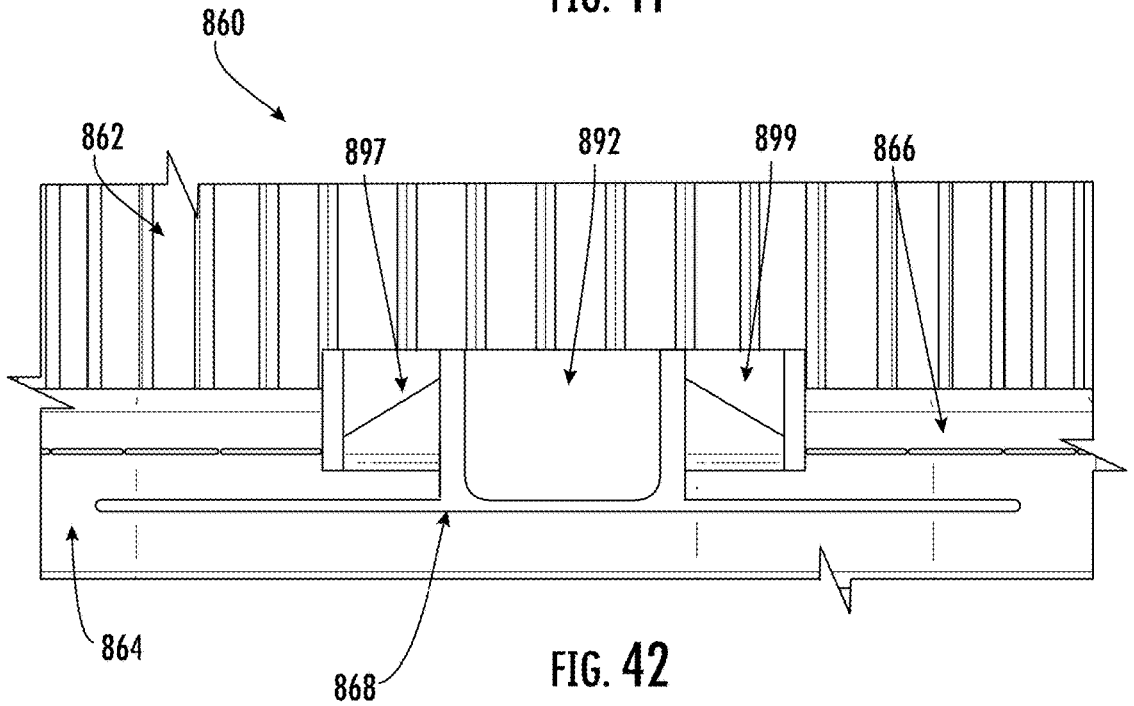
FIG. 42 is a detailed back view of the closure of FIG. 41, according to an exemplary embodiment.

Turning to FIGS. 41-42, various aspects of closure 860 are shown. Closure 860 is similar to closure 10 and the other closures except as described herein. Body 862 of closure 860 is separated from retaining band 864 by upper band of weakness 866. Body 862 is pivotally coupled to retaining band 864 via left and right tethers 897, 899. Left and right tethers 897, 899 extend between retaining band 864 and body 862. Tab 892 extends from body 862 away from top panel of closure 860. Tab 892 is defined by aperture 868, which extends around and defines tab 892.

Figure 43:
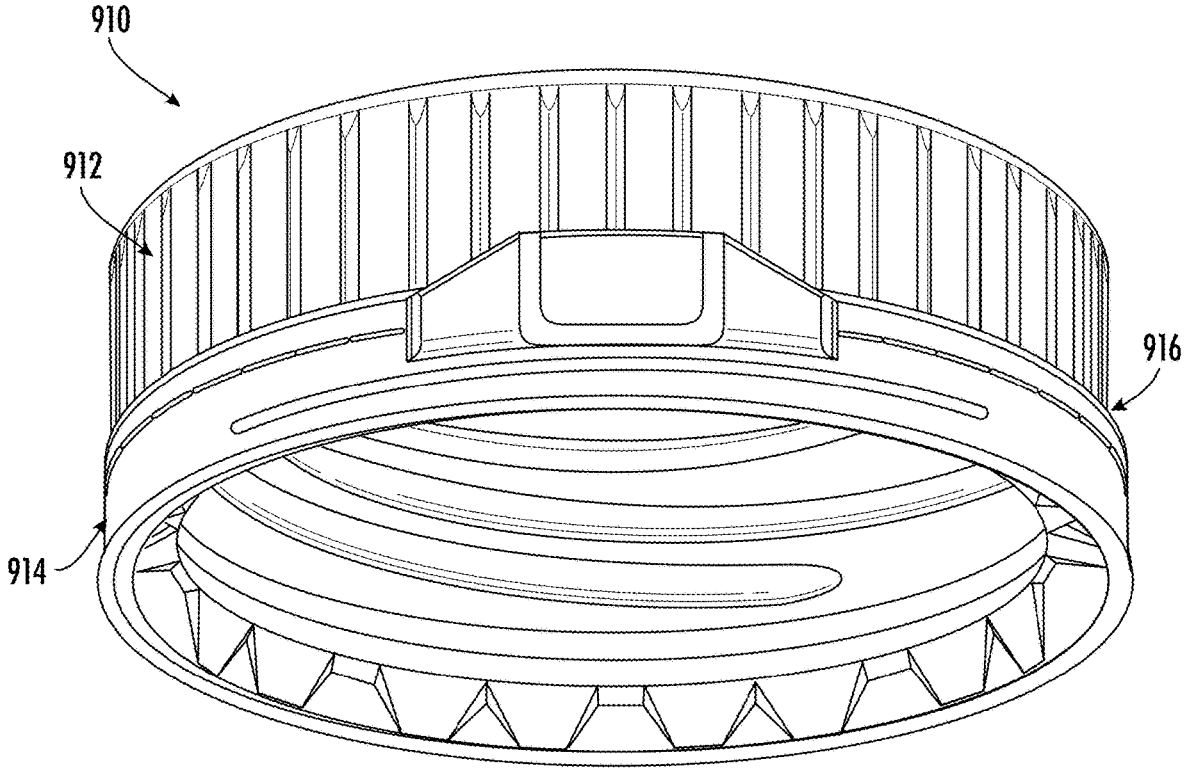
FIG. 43 is a perspective view of a closure, according to an exemplary embodiment.
Figure 44:
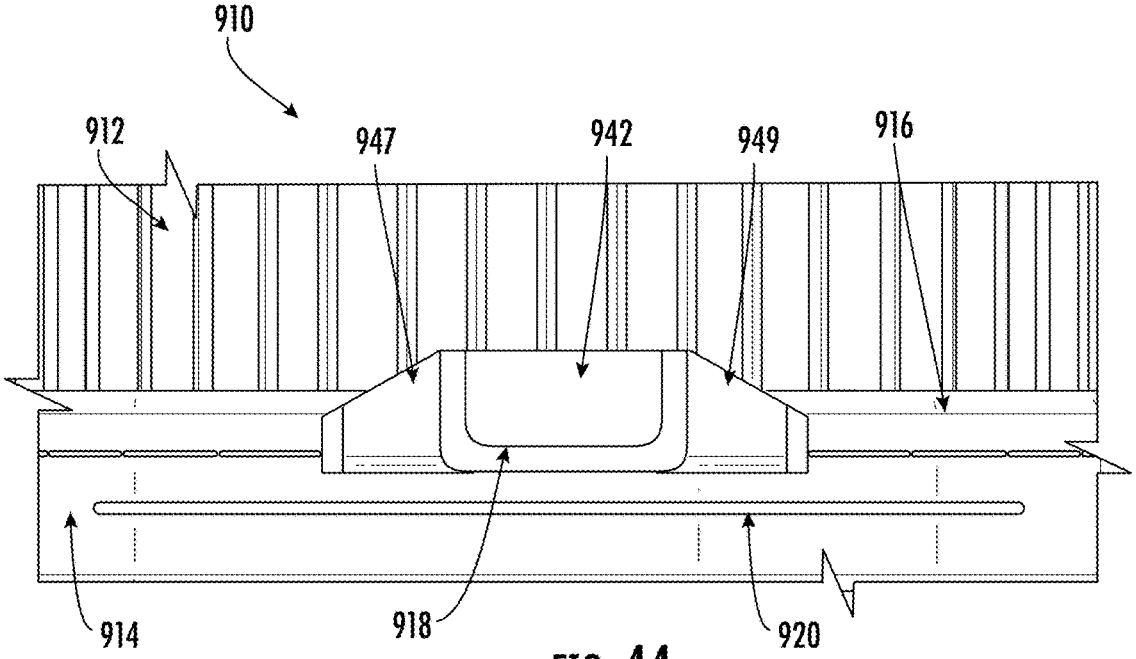
FIG. 44 is a detailed back view of the closure of FIG. 43, according to an exemplary embodiment.

Turning to FIGS. 43-44, various aspects of closure 910 are shown. Closure 910 is similar to closure 10 and the other closures except as described herein. Body 912 of closure 910 is separated from retaining band 964 by upper band of weakness 916. Body 912 is pivotally coupled to retaining band 914 via left and right tethers 947, 949. Left and right tethers 947, 949 extend between retaining band 914 and body 912. Tab 942 extends from body 912 away from top panel of closure 910. Tab 942 is defined by aperture 918, which extends around and defines tab 942. Closure 910 includes lower band of weakness, shown as band 920. In a specific embodiment, closure 910 is molded with band 920.

Figure 45:
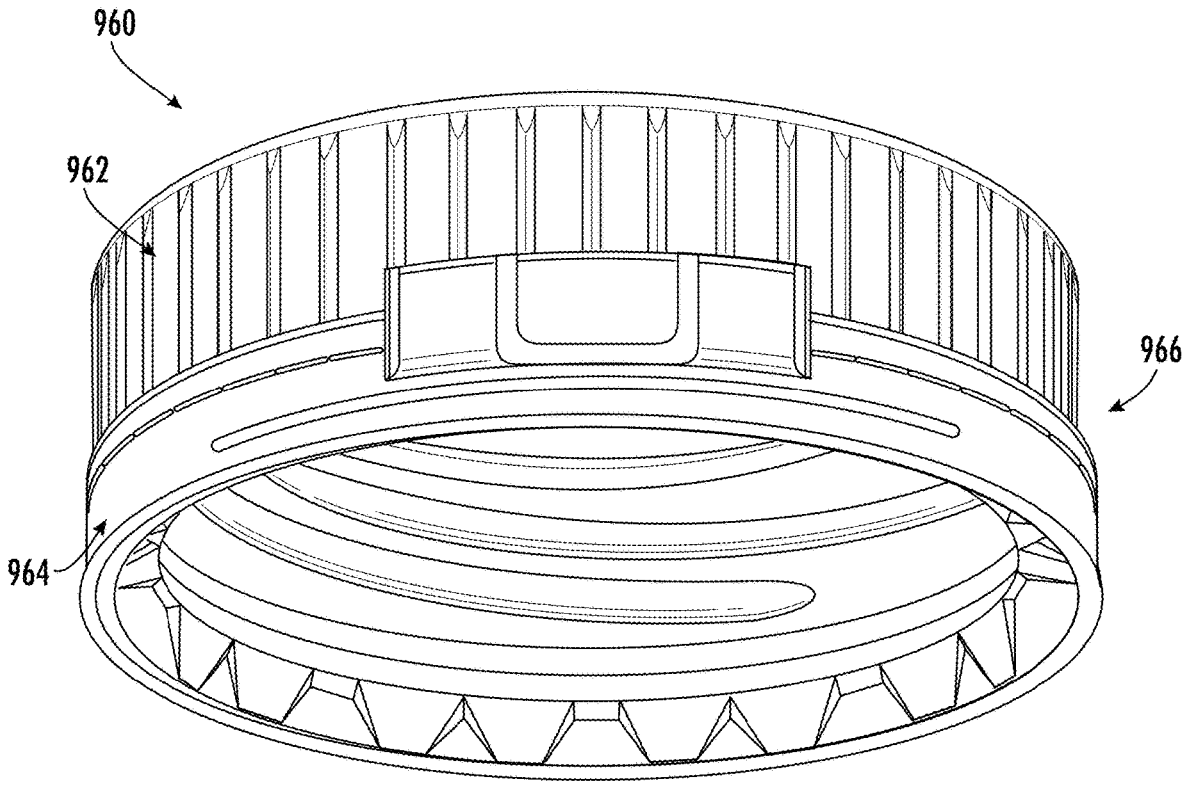
FIG. 45 is a perspective view of a closure, according to an exemplary embodiment.
Figure 46:
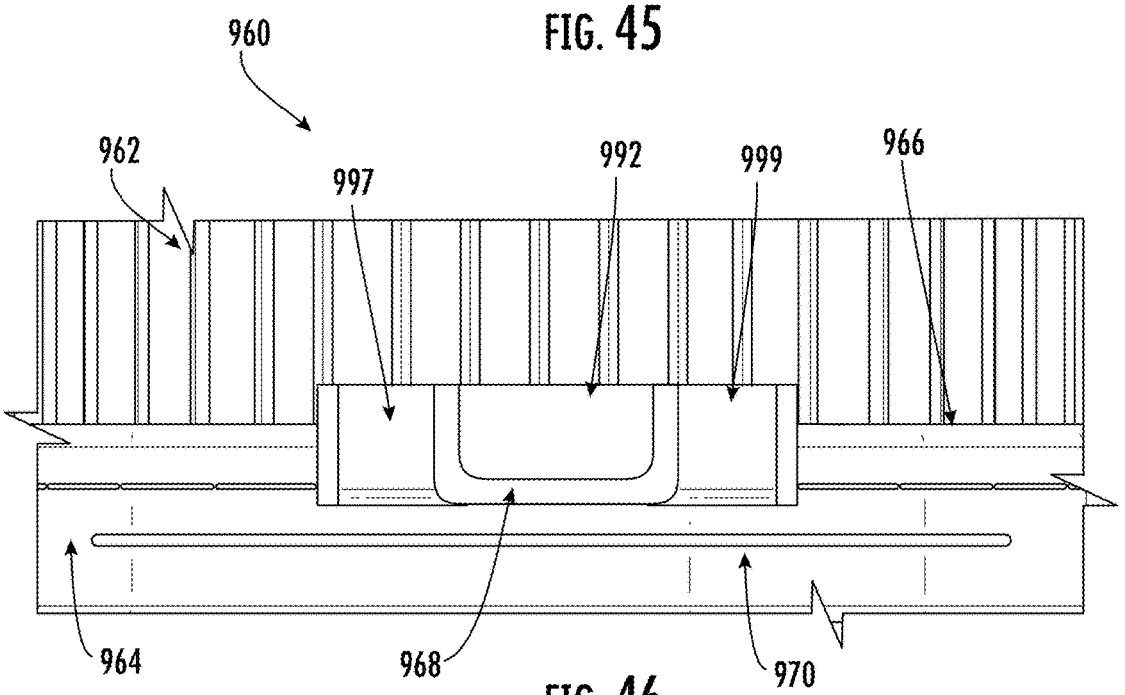
FIG. 46 is a detailed back view of the closure of FIG. 45, according to an exemplary embodiment.

Turning to FIGS. 45-46, various aspects of closure 960 are shown. Closure 960 is similar to closure 10 and the other closures except as described herein. Body 962 of closure 960 is separated from retaining band 964 by upper band of weakness 966. Body 962 is pivotally coupled to retaining band 964 via left and right tethers 997, 999. Left and right tethers 997, 999 extend between retaining band 964 and body 962. Tab 992 extends from body 962 away from top panel of closure 960. Tab 992 is defined by aperture 968, which extends around and defines tab 992. Closure 960 includes lower band of weakness, shown as band 970. In a specific embodiment, closure 960 is molded with band 970.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein the article "a" is intended to include one or more than one component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another, or with the two members and any additional member being attached to one another. Such joining may be permanent in nature or alternatively may be removable or releasable in nature. Various embodiments of the invention relate to any combination of any of the features, and any such combination of features may be claimed in this or future applications. Any of the features, elements, or components of any of the exemplary embodiments discussed above may be utilized alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

The invention claimed is:

1. A closure for a container comprising:

a top panel including an upper surface and a lower surface;

a rotational axis about which the top panel is centered;

a cylindrical wall extending from the lower surface of the top panel to a bottom edge of the cylindrical wall;

an inner surface of the cylindrical wall facing towards the rotational axis;

a retention band pivotally coupled to the cylindrical wall, the retention band attached to the bottom edge by a plurality of frangible members, the frangible members providing a visual indication, when broken, that the closure has been opened;

a line of weakness that separates the cylindrical wall and the retention band, wherein the plurality of frangible members extend across the line of weakness and connect the cylindrical wall and the retention band, the line of weakness extending circumferentially around the closure from a first end to a second end;

a tab that extends from the cylindrical wall, the tab configured to interface against a neck of the container to bias the cylindrical wall of the closure away from the container neck; and an interference band that extends from the retention band inwardly towards the rotational axis and upwardly towards the top panel, the interference band extends a first length from the retention band at a first location opposite the tab, the interference band comprising a second location opposite the first location with respect to the rotational axis, a third location circumferentially halfway between the first location and the second location, and a fourth location circumferentially halfway between the first location and the third location, wherein the interference band extends a second length at the third location, and a third length at the fourth location, wherein the second length is greater than the first length, and wherein the difference between the first length and the third length is the same as the difference between the second length and the third length.

2. The closure of claim 1, further comprising:

a first aperture extending vertically between the retention band and the cylindrical wall, the first aperture connected with the first end of the line of weakness when the closure is opened; and a second aperture extending vertically between the retention band and the cylindrical wall, the second aperture connected with the second end of the line of weakness when the closure is opened;

wherein the tab is located circumferentially between the first aperture and the second aperture.

3. The closure of claim 1, wherein the tab is defined by a third aperture defined between the cylindrical wall and the retention band.

4. The closure of claim 3, wherein the third aperture comprises:

a lower portion that extends circumferentially around the closure from a first end to a second end;

a first vertical portion that extends from the first end of the lower portion towards the top panel; and a second vertical portion that extends from the second end of the lower portion towards the top panel.

5. The closure of claim 3, further comprising:

a first aperture extending vertically between the retention band and the cylindrical wall, the first aperture connected with the first end of the line of weakness when the closure is opened; and a second aperture extending vertically between the retention band and the cylindrical wall, the second aperture connected with the second end of the line of weakness when the closure is opened;

wherein the tab is located between the first aperture and the second aperture.

6. The closure of claim 5, further comprising:

a first tether located between the first aperture and the third aperture, wherein the first tether maintains a coupling between the cylindrical wall and the retention band when the closure is opened; and a second tether located between the second aperture and the third aperture, wherein the second tether maintains a coupling between the cylindrical wall and the retention band when the closure is opened.

7. The closure of claim 6, wherein the third aperture comprises:

a lower portion that extends circumferentially around the closure from a first end to a second end;

a first vertical portion that extends from the first end of the lower portion towards the top panel; and a second vertical portion that extends from the second end of the lower portion towards the top panel.

8. The closure of claim 1, wherein the interference band is configured to engage a neck portion of the container to retain the retention band on the container neck when the closure has been opened.

9. The closure of claim 1, wherein the first length is less than 75% of a third length from a bottom of the retention band to a top of the retention band.

10. A closure for a container comprising:

a top panel including an upper surface and a lower surface;

a rotational axis around which the top panel is centered;

a cylindrical wall extending from the lower surface of the top panel to a bottom edge of the cylindrical wall;

an inner surface of the cylindrical wall facing towards the rotational axis;

a retention band pivotally coupled to the cylindrical wall, the retention band attached to the bottom edge by a plurality of frangible members, the frangible members providing a visual indication, when broken, that the closure has been opened;

a first line of weakness that separates the cylindrical wall and the retention band, wherein the plurality of frangible members extend across the first line of weakness and connect the cylindrical wall and the retention band, the first line of weakness extending circumferentially around the closure from a first end to a second end;

a second line of weakness that extends circumferentially around the retention band;

a tab that extends from the cylindrical wall, the tab configured to interface against a neck of the container to bias the cylindrical wall of the closure away from the container neck; and an interference band that extends from the retention band inwardly towards the rotational axis and upwardly towards the top panel, the interference band extends a first length from the retention band at a first location opposite the tab, the interference band comprising a second location opposite the first location with respect to the rotational axis, and a third location circumferentially halfway between the first location and the second location, wherein the length of the interference band increases linearly between the first location and the third location.

11. The closure of claim 10, wherein the tab is located between the second line of weakness and the top panel.

12. The closure of claim 10, further comprising:

a first aperture extending vertically between the retention band and the cylindrical wall, the first aperture connected with the first end of the first line of weakness when the closure is opened; and a second aperture extending vertically between the retention band and the cylindrical wall, the second aperture connected with the second end of the first line of weakness when the closure is opened;

wherein the tab is located circumferentially between the first aperture and the second aperture.

13. The closure of claim 12, wherein the tab is defined by a third aperture defined between the cylindrical wall and the retention band.

14. The closure of claim 13, wherein the third aperture comprises:

a lower portion that extends horizontally around the closure from a first end to a second end;

a first vertical portion that extends from the first end of the lower portion towards the top panel; and a second vertical portion that extends from the second end of the lower portion towards the top panel.

15. The closure of claim 14, further comprising:

a first tether located between the first aperture and the tab, wherein the first tether maintains a coupling between the cylindrical wall and the retention band when the closure is opened; and a second tether located between the second aperture and the tab, wherein the second tether maintains a coupling between the cylindrical wall and the retention band when the closure is opened;

wherein the tab is located circumferentially between the first aperture and the second vertical aperture.

16. The closure of claim 10, wherein the interference band is configured to engage a neck portion of the container to retain the retention band on the container neck when the closure has been opened.

17. The closure of claim 10, wherein the first length is less than 75% of a fourth length from a bottom of the retention band to a top of the retention band.

18. A closure for a container comprising:

a top panel including an upper surface and a lower surface;

a rotational axis about which the top panel is centered;

a cylindrical wall extending from the lower surface of the top panel to a bottom edge of the cylindrical wall;

an inner surface of the cylindrical wall facing towards the rotational axis;

a retention band pivotally coupled to the cylindrical wall, the retention band attached to the bottom edge by a plurality of frangible members, the frangible members providing a visual indication, when broken, that the closure has been opened;

a line of weakness that separates the cylindrical wall and the retention band, wherein the plurality of frangible members extend across the line of weakness and connect the cylindrical wall and the retention band, the line of weakness extending circumferentially around the closure from a first end to a second end;

a first aperture extending vertically between the retention band and the cylindrical wall, the first aperture connected with the first end of the line of weakness when the closure is opened;

a second aperture extending vertically between the retention band and the cylindrical wall, the second aperture connected with the second end of the line of weakness when the closure is opened;

a tab that extends from the cylindrical wall, the tab configured to interface against a neck of the container to bias the cylindrical wall of the closure away from the container neck;

a first tether located between the first aperture and the tab, wherein the first tether maintains a coupling between the cylindrical wall and the retention band when the closure is opened, and wherein the first tether includes a line of weakness that facilitates the first tether being deformed;

a second tether located between the second aperture and the tab, wherein the second tether maintains a coupling between the cylindrical wall and the retention band when the closure is opened, and wherein the first tether includes a line of weakness that facilitates the second tether being deformed; and an interference band that extends from the retention band inwardly towards the rotational axis and upwardly towards the top panel, the interference band extends a first length from the retention band at a first location opposite the tab, the interference band comprising a second location opposite the first location with respect to the rotational axis, and a third location circumferentially halfway between the first location and the second location, wherein the length of the interference band increases continuously between the first location and the third location.

19. The closure of claim 18, wherein the tab is defined by a third aperture defined between the cylindrical wall and the retention band, and wherein the third aperture comprises:

a lower portion that extends circumferentially around the closure from a first end to a second end;

a first vertical portion that extends from the first end of the lower portion towards the top panel; and a second vertical portion that extends from the second end of the lower portion towards the top panel.

20. The closure of claim 18, wherein the interference band is configured to engage a neck portion of the container to retain the retention band on the container neck when the closure has been opened.

* * * * *